US011095011B2

(12) United States Patent
Shamseldin et al.

(10) Patent No.: US 11,095,011 B2
(45) Date of Patent: Aug. 17, 2021

(54) RF STRIPLINE CIRCULATOR DEVICES AND METHODS

(71) Applicants: Shokry Ibrahim Abdelrazak Shamseldin, Laval (CA); Ahmed Abdelwahed Kishk, St. Hubert (CA); Mahmoud Sobhy Elsaadany, Edmonton (CA)

(72) Inventors: Shokry Ibrahim Abdelrazak Shamseldin, Laval (CA); Ahmed Abdelwahed Kishk, St. Hubert (CA); Mahmoud Sobhy Elsaadany, Edmonton (CA)

( * ) Notice: Subject to any disclaimer, the term of this patent is extended or adjusted under 35 U.S.C. 154(b) by 0 days.

(21) Appl. No.: 16/486,189

(22) PCT Filed: Feb. 16, 2018

(86) PCT No.: PCT/CA2018/000027
§ 371 (c)(1),
(2) Date: Aug. 15, 2019

(87) PCT Pub. No.: WO2018/148820
PCT Pub. Date: Aug. 23, 2018

(65) Prior Publication Data

US 2020/0006834 A1 Jan. 2, 2020

Related U.S. Application Data

(60) Provisional application No. 62/460,183, filed on Feb. 17, 2017.

(51) Int. Cl.
*H01P 1/387* (2006.01)
*H01P 1/383* (2006.01)

(52) U.S. Cl.
CPC ..... *H01P 1/387* (2013.01); *H01P 1/383* (2013.01)

(58) Field of Classification Search
CPC .... H01P 1/387; H01P 1/39; H01P 1/38; H01P 1/383; H01P 1/32; H01P 1/36
USPC ..... 333/1.1, 24.2
See application file for complete search history.

(56) References Cited

U.S. PATENT DOCUMENTS 7,242,264 B1 * 7/2007 How ..... H01P 1/362 333/1.1

* cited by examiner

*Primary Examiner* — Stephen E. Jones
(74) *Attorney, Agent, or Firm* — Rosenberg, Klein & Lee

(57) ABSTRACT

Microwave circulators are an essentially component in many microwave systems and whilst the waveguide technologies they are implemented in have evolved their design today still employs procedures that are typically approximate and have no regular approach, which in many instances is through dependence on empirical equations or considered a trade secret that gives an edge to commercial suppliers of microwave and RF circulators. The result is expensive isolators where high performance is required as they are merely selected out or require manual tuning. Further, for broadband systems, designer's resort to dividing into sub-bands deploying multiple narrower band circulators. Accordingly, the inventors present a design methodology based on an accurate closed form solution allowing the selection of suitable ferrite specifications for the required operating bandwidth as well as calculating the ferrite disc impedance allowing the necessary matching network to be designed and the circulator design completed.

15 Claims, 11 Drawing Sheets

Figure16A
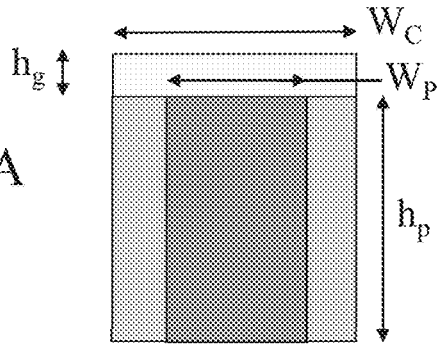
Figure 16B
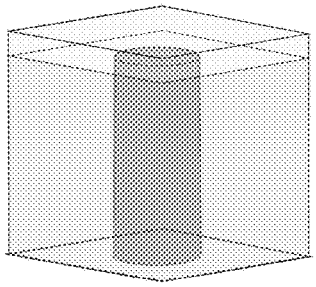
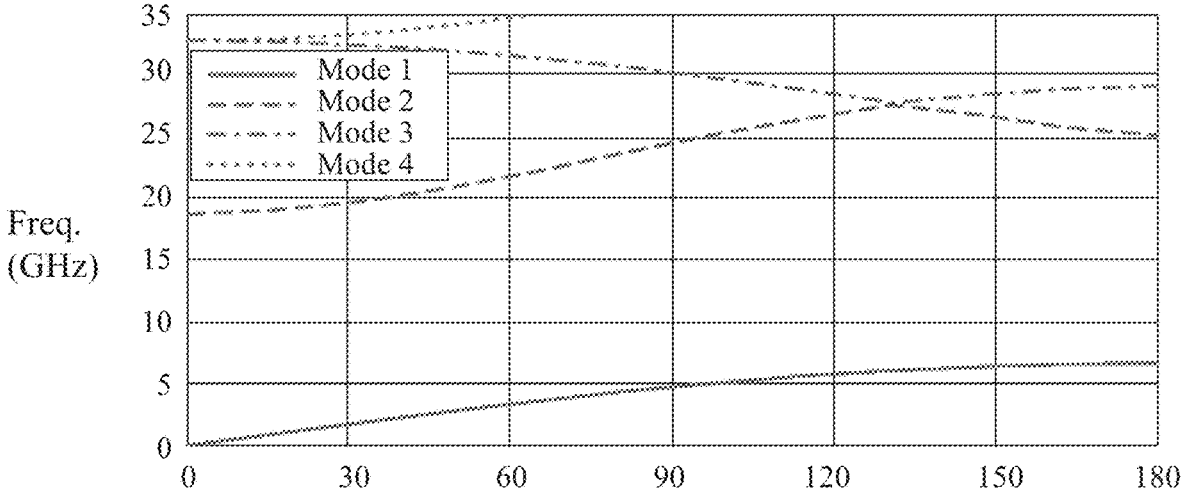
Figure 16C
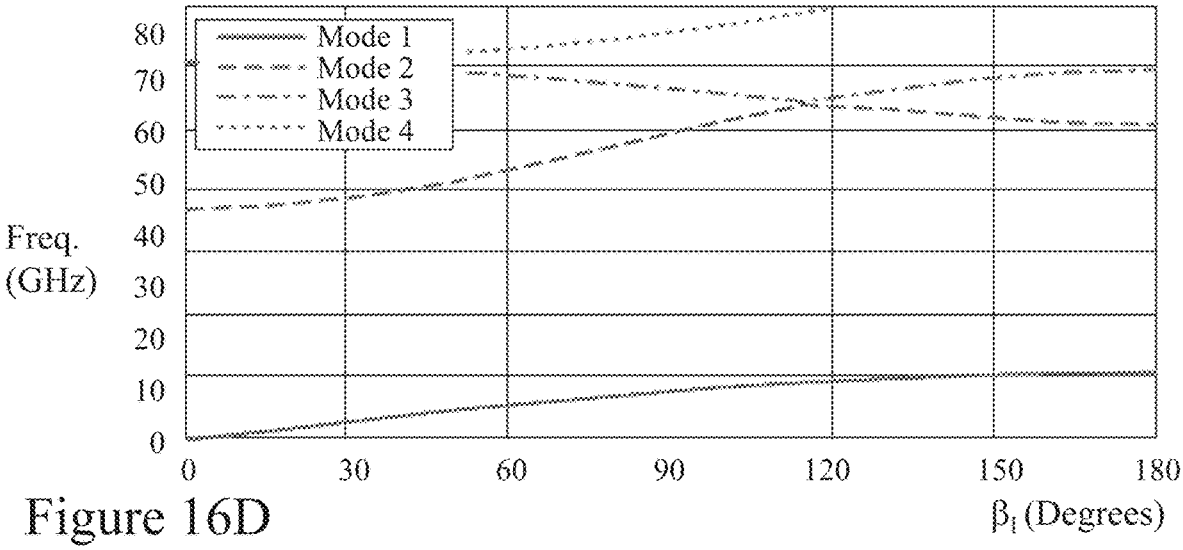
Figure 16D

RF STRIPLINE CIRCULATOR DEVICES AND METHODS

CROSS-REFERENCE TO RELATED APPLICATIONS

This patent application claims the benefit of priority from International Patent Application PCT/CA2018/000,027 entitled "RF Stripline Circulator Devices and Methods" filed Feb. 16, 2018; which itself claims the benefit of priority from U.S. Provisional Patent Application 62/460,183 entitled "RF Stripline Circulator Devices and Methods" filed Feb. 17, 2017; the entire contents of each being incorporated herein by reference.

FIELD OF THE INVENTION

This invention relates to both RF stripline circulators and to ridge gap circulators and a systematic design procedure—a methodology for both, stripline and ridge gap circulators with an intentionally designed air gap around the ferrite disc.

BACKGROUND OF THE INVENTION

Microwave circulators were proposed 60 years ago, to be deployed in different communication systems and radar applications and have gone through substantial development subsequently. Initially, circulators were designed according to Faraday rotation and were developed for high power handling devices such as resonance circulators and differential phase shift circulators. One of the most important configurations is the junction circulator, also known as a turnstile circulator or Y-circulator. The configuration of this circulator is formed using a Y-shaped structure with three identical guiding structures in the middle of which a ferrite disc is located. This middle section provides the nonreciprocal characteristics of the Y-junction. The three identical arms can be rectangular waveguides, striplines, microstrip lines, or any guiding structure. The objective over this period of time for RF-microwave circuit designers being to achieve improved electrical specifications within a smaller footprint and/or lower cost. Recently, modern guiding structures have been established for circulator implementations such as those employed within Substrate Integrated Waveguide (SIW) and the coupled line circulators. Modern fabrication techniques are now also utilized to produce semiconductor based and MIMIC based circulators, as well.

Amongst these, the new guiding structures that require components based on its technology is the ridge gap waveguide (RGW), which was introduced recently in 2009. The concept of this configuration builds on the concepts of soft and hard surfaces wherein the design methodology is to have full confinement of the microwave (RF) signal between two parallel plate like structures. The signal leakage is eliminated by the existence of a two-dimensional (2D) soft surface surrounding the signal path, which forms an Artificial Magnetic Conductor (AMC). The AMC with the Perfect Electrical Conductor (PEC), the upper ground of the RGW, prevents the signal from propagating (leaking) outside the ridge. The basic concepts of the RGW waveguide have been addressed and tested in many publications within the prior art. One of the advantages of the RGW structure is its broad operating bandwidth that can exceed 3:1 in some prior art embodiments.

However, within this prior art, which has yielded many models for the junction analysis to describe the characteristics of the junctions mathematically and used multiple numerical techniques in achieving circulator solutions, the procedures are typically approximate and have no regular approach, which in many instances is through dependence on empirical equations or considered a trade secret that gives an edge to commercial suppliers of microwave and RF circulators. Thus, the design solutions available within the prior art are inaccurate and lead to production process that pass through an iterative process between the testing laboratory and the machine shop (and other processing stages) in addition to which wideband circulators have to post-fabrication tuned. As a result, system engineers tend to divide the operating bandwidth into sub-bands deploying multiple narrower band circulators within the system in an attempt to overcome these issues. Further, the impedance matching section for the circulator junction either exploits expensive "special composite materials" and/or requires post-fabrication processing.

Accordingly, it would be beneficial to provide component and circuit designs with a systematic approach to designing circulators with closed form expressions. It would be further beneficial for such closed form expressions to be applicable to any frequency band with proper scaling. Such a methodology allowing for reductions in the time required for design, fabrication, and testing, and the cost of each circulator whilst enabling the availability of ultra-wideband circulators with reasonable costs and production logistics.

Within this specification, the inventors present such a design methodology based on an accurate closed form solution allowing the selection of suitable ferrite specifications for the required operating bandwidth as well as calculating the ferrite disc impedance allowing the necessary matching network to be designed. Further, the inventors have established an alternative circulator design employing:

- A dielectric filling within the RGW to match the waveguide striplines feeding to the center disc;
- A perforated substrate to achieve the required effective permittivity for impedance matching;
- Employing a standard substrate to achieve the lowest possible cost; and
- Employing an air gap around the ferrite disc to minimize the fringing fields and bound the effective diameter of the disc close to its physical diameter.

Based on these design algorithms and fabrication considerations ultra-wideband circulator production may be achieved with reduced time and cost with enhanced performance characteristics. Exemplary implementations with respect to two designs centered at 15 GHz and 30 GHz respectively, for 5G mobile applications are presented.

Other aspects and features of the present invention will become apparent to those ordinarily skilled in the art upon review of the following description of specific embodiments of the invention in conjunction with the accompanying figures.

SUMMARY OF THE INVENTION

It is an object of the present invention to mitigate limitations within the prior art relating to RF stripline circulators and to ridge gap circulators and a systematic design procedure—a methodology for both, stripline and ridge gap circulators with an intentionally designed air gap around the ferrite disc.

In accordance with an embodiment of the invention, there is provided a method of designing a microwave circulator comprising:

1) Solving a predetermined set of closed form equations at a predetermined frequency relating to the electrical and magnetic fields with respect to an electrically non-conductive and ferromagnetic element comprising a first predetermined portion of the microwave circulator; and 2) Designing a matching transformer to cover a predetermined bandwidth of operation depending on the simulation data established in step (1), the simulation data comprising a set of physical properties of the electrically non-conductive and ferromagnetic element, a set of physical properties of a plurality of microwave ports forming a second predetermined portion of the microwave circulator and a set of electrical properties of the microwave ports.

In accordance with an embodiment of the invention, there is provided a microwave circulator comprising:

a pair of electrically non-conductive and ferromagnetic elements with specific magnetic saturation value ($M_s$) each having a predetermined thickness and a predetermined diameter;

an electrical conductor plane comprising a plurality of microwave tracks and a central circular pad to which each microwave track is coupled at a predetermined location, each microwave track comprising a first portion adjacent the central pad and a second portion extending from the first portion to a distal point;

a lower electrical ground plane;

an upper electrical ground plane;

a first dielectric disposed between the electrical conductor plane and the lower electrical ground plane and having a thickness determined in dependence upon the predetermined thickness of the electrically non-conductive and ferromagnetic elements and an opening determined in dependence upon the predetermined diameter of the electrically non-conductive and ferromagnetic elements;

a second dielectric disposed between the electrical conductor plane and the upper electrical ground plane and having a thickness determined in dependence upon the predetermined thickness of the electrically non-conductive and ferromagnetic elements and an opening determined in dependence upon the predetermined diameter of the electrically non-conductive and ferromagnetic elements; wherein the openings within the first dielectric and second dielectric have a diameter establishing a predetermined air gap between the external periphery of an electrically non-conductive and ferromagnetic element and their respective dielectric when the electrically non-conductive and ferromagnetic element is centrally disposed of with the opening;

the first portion of each microwave track is air filled microwave track; and the second portion of each microwave track is a dielectric filled microwave track.

In accordance with an embodiment of the invention, there is provided a microwave circulator comprising:

a set of three parallel electrical planes wherein the middle electrical plane comprises a plurality of microwave tracks and a central region coupled to the plurality of microwave tracks and each outer electrical plane is a ground plane; wherein a central portion of the set of three parallel electrical layers comprises an inner region with electrically non-conductive and ferromagnetic elements of predetermined lateral dimensions disposed between each outer electrical plane and the middle electrical plane and an outer region filled with a first dielectric material of low dielectric constant such that those portions of each microwave track in this outer region form microwave feeds coupled to the central region of the middle electrical plane at predetermined locations;

an outer portion of the set of three parallel electrical layers is filled with a second dielectric material such that those portions of each microwave track in this outer portion form microwave matching networks between the part of each microwave track in the outer region of the central portion and an external microwave circuit to be coupled to the distal ends of each microwave track from the central portion.

In accordance with an embodiment of the invention, there is provided a method of designing a microwave circulator comprising:

1) solving a predetermined set of closed form equations at a predetermined frequency relating to the electrical and magnetic fields with respect to an electrically non-conductive and ferromagnetic element comprising a first predetermined portion of the microwave circulator with low dielectric constant material based microwave waveguides coupling to the electrically non-conductive and ferromagnetic element; and 2) designing a matching transformer to cover a predetermined bandwidth of operation in dependence upon simulation data established in step (1) using high dielectric constant substrate based microwave waveguides forming a matching network between the waveguides coupling to the electrically non-conductive and ferromagnetic element and an external microwave circuit coupled to the microwave circulator, the simulation data comprising a set of physical properties of the electrically non-conductive and ferromagnetic element, a set of physical properties of a plurality of microwave ports forming a second predetermined portion of the microwave circulator and a set of electrical properties of the microwave ports.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein:

FIGS. 16A and 16B depict a front view and 3D view of the "bed of nails" unit cell for the RGW structure;

FIGS. 16C and 16D depict the dispersion relationships for the "bed of nails" unit cells for the RGW structure at 15 GHz and 30 GHz respectively;

DETAILED DESCRIPTION

Figure 1:
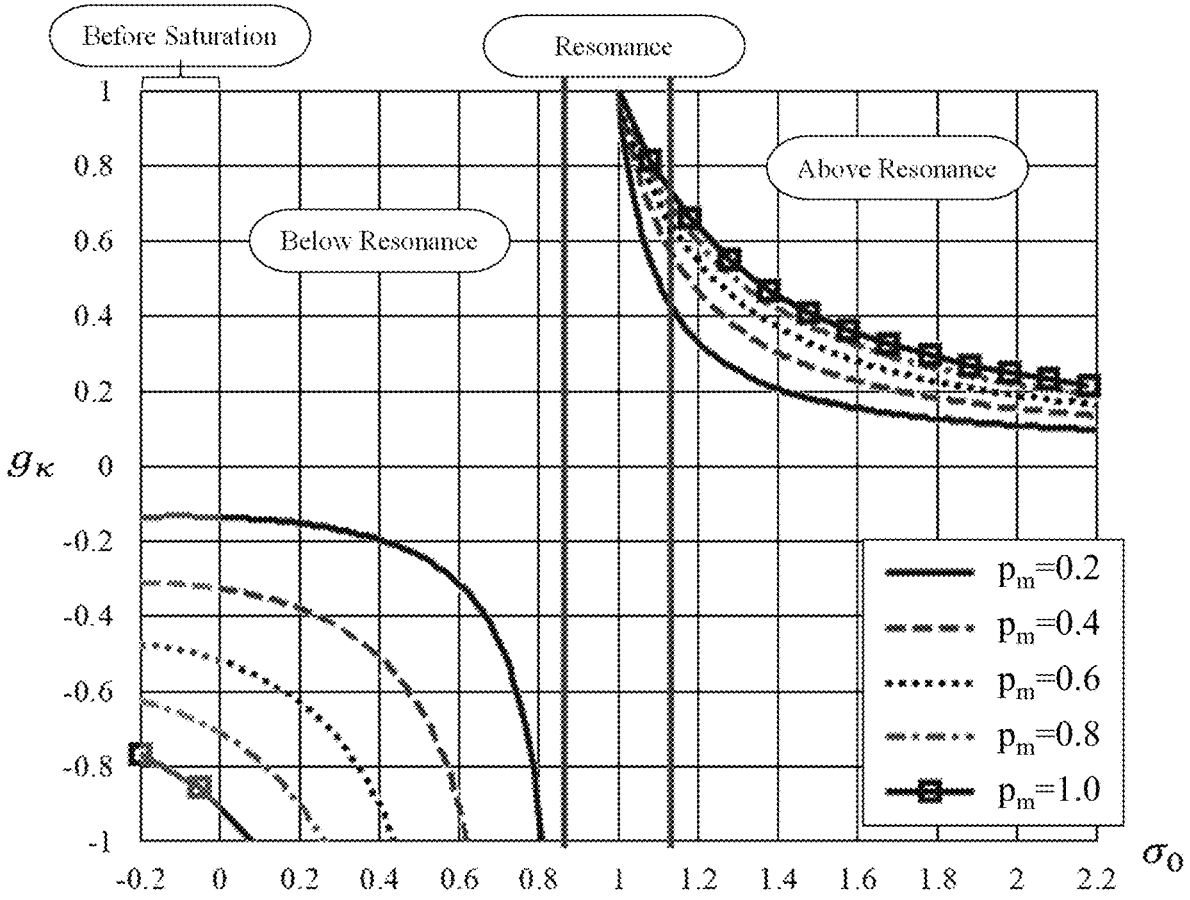
FIG. 1 depicts the Gytropy versus the normalized Larmor frequency for a ferrite disc saturated in the $\hat{z}$ direction.

The present invention is directed to RF stripline circulators and to ridge gap circulators and a systematic design procedure—a methodology for both, stripline and ridge gap circulators with an intentionally designed air gap around the ferrite disc.

The ensuing description provides representative embodiment(s) only and is not intended to limit the scope, applicability or configuration of the disclosure. Rather, the ensuing description of the embodiment(s) will provide those skilled in the art with an enabling description for implementing an embodiment or embodiments of the invention. It is being understood that various changes can be made in the function, and arrangement of elements without departing from the spirit and scope as set forth in the appended claims. Accordingly, an embodiment is an example or implementation of the inventions and not the sole implementation. Various appearances of "one embodiment", "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention can also be implemented in a single embodiment or any combination of embodiments.

Reference in the specification to "one embodiment", "an embodiment", "some embodiments" or "other embodiments" means that a particular feature, structure, or characteristics described in connection with the embodiments is included in at least one embodiment, but not necessarily all embodiments, of the inventions. The phraseology and terminology employed herein are not to be construed as limiting, but is for descriptive purpose only. It is to be understood that where the claims or specification refer to "a" or "an" element, such reference is not to be construed as there being only one of that element. It is to be understood that where the specification states that a component feature, structure, or characteristics "may", "might", "can" or "could" be included, that particular component, feature, structure, or characteristics are not required to be included.

Reference to terms such as "left", "right", "top", "bottom", "front" and "back" are intended for use in respect to the orientation of the particular feature, structure, or element within the figures depicting embodiments of the invention. It would be evident that such directional terminology with respect to the actual use of a device has no specific meaning as the device can be employed in a multiplicity of orientations by the user or users. Reference to terms "including", "comprising", "consisting" and grammatical variants thereof do not preclude the addition of one or more components, features, steps, integers or groups thereof, and that the terms are not to be construed as specifying components, features, steps or integers. Likewise, the phrase "consisting essentially of", and grammatical variants thereof, when used herein is not to be construed as excluding additional components, steps, features, integers or groups thereof, but rather that the additional features, integers, steps, components or groups thereof do not materially alter the basic and novel characteristics of the claimed composition, device or method. If the specification or claims refer to "an additional" element, that does not preclude there being more than one of the additional elements.

1. Background—Normalized Magnetic Factors and Gytropy

Expressions for both normalized magnetic factors are listed below in Table 1 and are addressed in more detail below.

TABLE 1

Permeability Tensor Important Expressions

| The Physical Quantity | Symbol | Expression |
|---|---|---|
| Gytropy | $k/\mu$ | $\frac{\omega\ \omega_0}{\omega_0^2+\omega^2+\omega_0\omega_m}$ |
| Diagonal elements | $\mu$ | $\mu_0(1+\Psi_{xx})=\mu_0(1=\Psi_{yy})$ |
| Off diag. elements | $k$ | $-j\mu_0\Psi_{xy}=j\mu_0\Psi_{yx}$ |
| Diagonal susceptibility | $\Psi_{xx}$ | $\frac{\omega_0\omega_m}{\omega_0^2-\omega^2}$ |

TABLE 1-continued

| Permeability Tensor Important Expressions | | |
|---|---|---|
| The Physical Quantity | Symbol | Expression |
| Larmor angular frequency | $\omega_0$ | $\mu_0\gamma$"$H_0$(A/m)" $2\pi * 2.8 * 10^6$ "$H_0(O_e)$" |
| Magnetic angular frequency | $\omega_m$ | $\mu_0\gamma$"$M_0$(A/m)" $2\pi * 2.8 * 10^6$ "$(4\pi M_s)$(G)" |
| Normalized Larmor frequency | $\sigma_0$ | $\frac{\omega_0}{\omega} = \frac{2.8*10^6 \text{ "}H_0(O_e)\text{"}}{f}$ |
| Normalized magnetic frequency | $p_m$ | $\frac{\omega_m}{\omega} = \frac{2.8*10^6 \text{ "}(4\pi M_s)(G)\text{"}}{f}$ |

The normalized Larmor frequency is denoted by $\sigma_0$, while the normalized magnetic frequency is denoted by $p_m$. Both are normalized to the operating frequency. The modes of any circulator operation can be shown easily based on these factors. The normalized Larmor frequency $\sigma_0$ can be also written in terms of the resonance magnetic field and the actual bias as defined by Equation (1).

$$\sigma_0 = \frac{\omega_0}{\omega} = \frac{2.8*10^{6''}H_0(O_e)''}{f} = \frac{H_0}{H_r} \tag{1}$$

This makes $\sigma_0=1$ is the boundary between the above resonance mode and the below resonance mode. The negative values of $\sigma_0$ corresponds to negative value of $H_0$. This occurs only when the applied external magnetic field is not sufficient for saturation. In this case the losses due to unsaturated ferrites will be dominant. The Gytropy ($g_k=k/\mu$) can be related to the normalized magnetic factors through Equation (2).

$$g_k = \frac{p_m}{\sigma_0^2 + \sigma_0 p_m - 1} \tag{2}$$

This equation is plotted for different $p_m$ values in FIG. 1 and all modes of operations are indicated in FIG. 1. The region before ferrite saturation is, also, indicated in FIG. 1, where the losses increase dramatically. This region is not an operating mode for any circulator. The resonance mode exits around the value of $\sigma_0=1$, where it is indicated roughly in this FIG. 1. To indicate this region exactly, the line width of the material should be given and it can be indicated by Equation (3).

$$1 - \frac{\Delta H}{H_r} < \sigma_0 < 1 + \frac{\Delta H}{H_r} \tag{3}$$

This curve in FIG. 1 is crucial in the design procedure as the circulator specifications are related to the Gytropy $|g_k|$. Based on the required value of $|g_k|$, this curve is utilized to select the suitable $\sigma_0$ and $p_m$. This leads to the choice of the utilized ferrite material and the applied bias. Another prospective in the design procedure is to assume a relation between the saturation magnetization of the material and the applied magnetic field as given by Equation (4) which will be the same ratio between the normalized Larmor frequency and the normalized magnetic frequency in Equation (5), where, $\alpha$ is called the magnetic biasing ratio. Dealing with $\alpha$ as a design parameter, reduces the number of unknowns by one.

$$H_0(O_e) = 4\pi M_s(G) * \alpha \tag{4}$$

$$\sigma_0 = \alpha p_m \tag{5}$$

$$g_k = \frac{p_m}{(\alpha^2 + \alpha)p_m^2 - 1} \tag{6}$$

$$p_m = \frac{1}{2(\alpha^2 + \alpha)g_k}\left[1 \pm \sqrt{1 \pm 4g_k^2(\alpha^2 + \alpha)}\right] \tag{7}$$

Rewriting the relation between the Gytropy and the normalized magnetic factors yields Equation (6) which can be reformed as Equation (7). Therefore, by selecting the magnetic biasing ratio, the material can be determined to achieve the required Gytropy. It is important to mention that the majority of the circulator designers start their analysis with the assumption of having $\alpha=0$. This is based on the assumption that the material is just saturated. This assumption is practically invalid. The magnets deployed to provide the DC magnetic biasing are usually permanent magnets. There is no practical methodology to increase the magnetic field in a continuous way. Initially, the magnetic bias starts with a top and a bottom magnet. It is possible to add one magnetic disc or two discs. Sometimes, it is possible to add a smaller magnet disc, however, the design consideration of having exact saturation is critical. Losing the required biasing point in this case leads to go in the low field losses region.

2. Junction Circulator Mathematical Formulations

As is normal in electromagnetic problems the starting point are Maxwell's equations, which can be written in the source free case as Equations (8) and (9) where, in the case of the ferrite material the permeability is represented by a tensor given by Equation (10), which assumes the ferrite disc is saturated in the z-direction, can be expressed as given by Pozar in "Microwave Engineering" (John Wiley & Sons, 3rd Edition, 2005) in Equation (11).

$$\nabla \times \overline{E} = -j\omega\overline{B} \tag{8}$$

$$\nabla \times \overline{H} = -j\omega\overline{D} \tag{9}$$

$$\overline{B} = [\mu]\overline{H} \tag{10}$$

$$[\mu] = \begin{bmatrix} \mu & j\kappa & 0 \\ -j\kappa & \mu & 0 \\ 0 & 0 & \mu_0 \end{bmatrix} \tag{11}$$

This representation is valid in both rectangular and cylindrical coordinate representations. The expressions used to calculate $\mu$ and k are summarized in Table 1. Hence, these equations can be rewritten as Equations (12) and (13).

$$\nabla\times\overline{E}=-j\omega[\mu]\overline{H} \tag{12}$$

$$\nabla\times\overline{H}=-j\omega\varepsilon\overline{E} \tag{12}$$

Maxwell equations are solved in the cylindrical coordinates, taking into consideration the permeability tensor of a saturated ferrite in the z-direction. The axial variation is assumed to be zero, i.e. $\partial/\partial z=0$. Solving Equation (12) yields Equations (14) and (15) and solving the previous two equations together, the transverse magnetic field intensities can be related to the axial electric field through the following Equations (16) and (17), respectively, where the effective wave number, the effective intrinsic admittance and the effective permeability are expressed by Equations (18) to (20), respectively.

$$\frac{1}{\rho}\frac{\delta E_z}{\delta\phi} = -j\omega(\mu H_\rho + j\kappa H_\phi) \tag{14}$$

$$-\frac{\delta E_z}{\delta\rho} = -j\omega(-j\kappa H_\rho + \mu H_\phi) \tag{15}$$

$$H_\rho = \frac{jY_{0eff}}{k_{eff}\mu}\left(\mu\frac{\delta E_z}{\delta\rho} + \frac{\mu}{\rho}\frac{\delta E_z}{\delta\phi}\right) \tag{16}$$

$$H_\phi = \frac{-jY_{0eff}}{k_{eff}\mu}\left(\mu\frac{\delta E_z}{\delta\rho} + \frac{-j\kappa}{\rho}\frac{\delta E_z}{\delta\phi}\right) \tag{17}$$

$$k_{eff} = \omega\sqrt{\varepsilon\mu_{eff}} \tag{18}$$

$$Y_{0eff} = \sqrt{\varepsilon/\mu_{eff}} \tag{19}$$

$$\mu_{eff} = (\mu^2 - \kappa^2)/\mu \tag{20}$$

Solving Equation (13), another relation between the axial electric field and the transverse magnetic field can be obtained as given by Equation (21).

$$\frac{1}{\rho}\left[\frac{\delta(\rho H_\phi)}{\delta\rho} - \frac{\delta H_\rho}{\delta\phi}\right] = j\omega\varepsilon E_z \tag{21}$$

$$\rho^2\frac{\delta^2 E_z}{\delta\rho^2} + \rho\frac{\delta E_z}{\delta\rho} + \rho^2 k_{eff}^2 E_z + \frac{\delta^2 E_z}{\delta\phi^2} = 0 \tag{22}$$

Substituting by Equations (16) and (17) in Equation (21) yields Equation (22). This equation is the same differential equation obtained while solving the TM mode in the cylindrical waveguide and the solution takes the following form in Equation (23).

$$E_{zn} = A_n J_n(k_{eff}\rho)e^{jn\phi} \tag{23}$$

$$H_{\phi n} = -jY_{eff}A_n R_n^h(k_{eff}\rho)e^{jn\phi} \tag{24}$$

$$R_n^h(k_{eff}\rho) = J_n'(k_{eff}\rho) + \frac{ng_\kappa}{k_{eff}\rho}J_n(k_{eff}\rho) \tag{25}$$

$$R_n^e(k_{eff}\rho) = J_n(k_{eff}\rho) \tag{26}$$

Only Bessel functions of the first kind are considered as the solution has to be finite at P=0, whilst Bessel functions of the second kind go to 1 at this point. Substituting into Equation (17), an expression of H_ can be obtained in Equation (24) where $R_n^h(k_{eff}\rho)$ is given by Equation (25). Keeping in mind that the mode order n can take positive and negative values, the previous function defines the magnetic field distribution in p direction for two counter-rotation of odes, while the corresponding function for the electric field is a Bessel function of the first kind and it can be written as Equation (26).

The previous expressions describe all possible modes inside the ferrite resonator. The field inside this resonator is the summation of all possible modes. The fields can be expressed as Equations (27) and (28).

$$E_z = \sum[A_n R_n^e(k_{eff}\rho)e^{jn\phi}] \tag{27}$$

$$H_\phi = -jY_{eff}\sum[A_n R_n^h(k_{eff}\rho)e^{jn\phi}] \tag{28}$$

$$\sin(\psi) = \frac{W}{2a} \tag{29}$$

Figure 2:
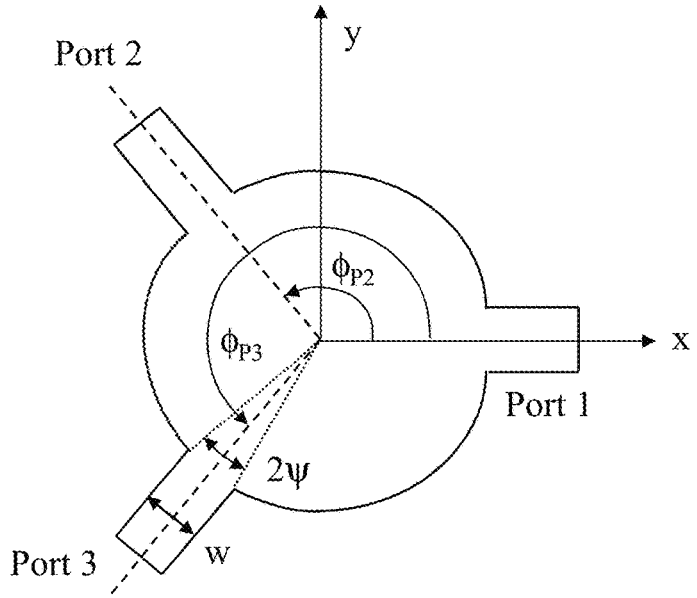
FIG. 2 depicts a schematic of a junction circulator according to an embodiment of the invention.
Figure 3A:
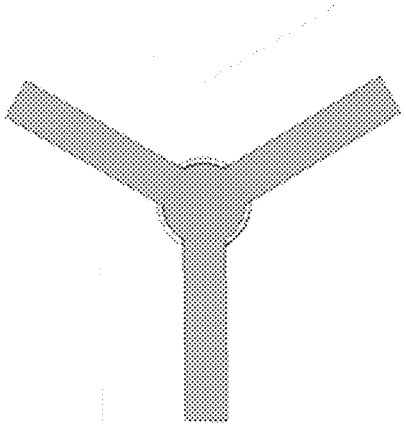
FIGS. 3A and 3B depict the simulated model for a circulator according to an embodiment of the invention exploiting straight arms in top view and three-dimensional (3D) model respectively.
Figure 3B:
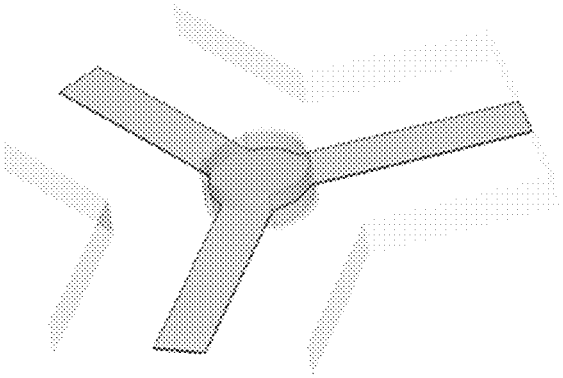
Figure 3C:
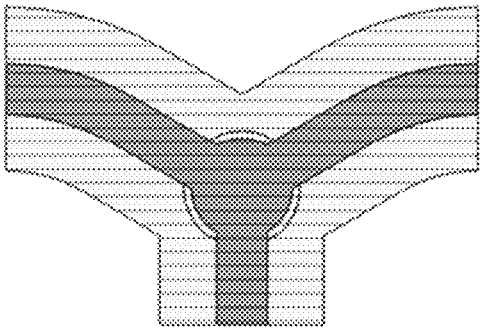
FIGS. 3C to 3F depict the simulated model for a circulator according to an embodiment of the invention exploiting curved arms in top views and three-dimensional (3D) models.
Figure 3D:
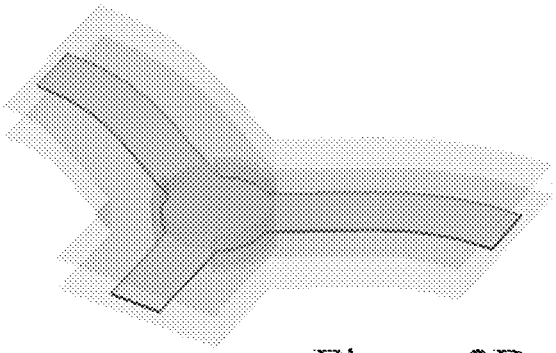
Figure 3E:
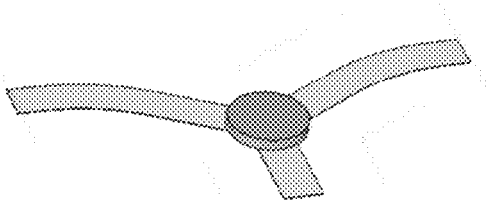
Figure 3F:
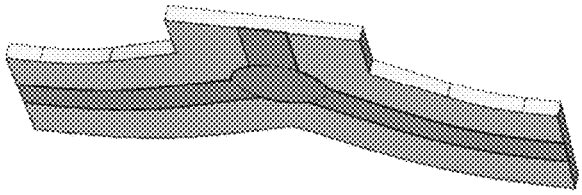
Figure 3G:
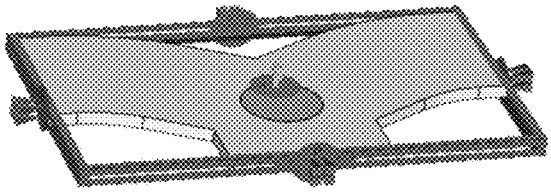
FIGS. 3G and 3H depict the simulated model for a circulator according to an embodiment of the invention exploiting two curved arms in three-dimensional (3D) model respectively focusing on the Perfect Electrical Conductor (PEC) and Perfect Magnetic Conductor (PMC) boundary conditions respectively.
Figure 3H:
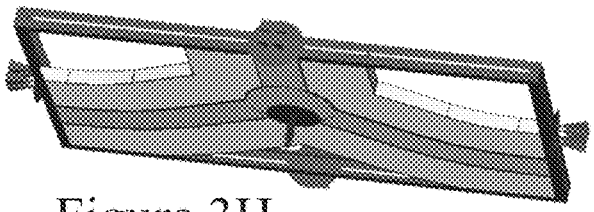

The circulators schematic configuration is shown in FIG. 2 whilst the simulated model of an ideal RGW circulator is depicted in FIGS. 3A to 3H respectively. FIGS. 3A and 3B illustrate the simulated model for a circulator according to an embodiment of the invention exploiting straight arms in top view and three-dimensional (3D) model, respectively, whilst FIGS. 3C to 3F illustrate the simulated model according to an embodiment of the invention with curved arms. FIGS. 3G and 3H depict the simulated model for a circulator according to an embodiment of the invention exploiting two curved arms in three-dimensional (3D) model respectively focusing on the Perfect Electrical Conductor (PEC) and Perfect Magnetic Conductor (PMC) boundary conditions respectively.

The coupling area at each port is determined by the port width W and the coupling angle. These can be related to each other by Equation (29). The basic function of the circulator is to couple all the input power from port 1 to port 2. The required field distribution for this functionality has to have a Poynting vector in $-\hat{a}_p$ at Ø=0 and a Poynting vector in $\hat{a}$ at $Ø=Ø_{p2}=120°$ (at the surface of the resonator p=a). The isolation condition of the circulator means that no power is coupled to port 3. This can be achieved only if both fields vanish at $Ø=Ø_{p3}=240°$. The required field distribution to satisfy the circulator conditions can be stated mathematically by Equations (30) and (31) with the conditions defined by Equations (32) and (33).

$$E_{z,req}(a,\phi) = \begin{cases} E_{z1}^{out} & -\psi < \phi < \psi \\ E_{z2}^{out} & 2\pi/3 - \psi < \phi < 2\pi/3 + \psi \\ 0 & 4\pi/3 - \psi < \phi < 4\pi/3 + \psi \end{cases} \tag{30}$$

$$H_{\phi,req}(a,\phi) = \begin{cases} H_{z1}^{out} & -\psi < \phi < \psi \\ H_{z2}^{out} & 2\pi/3 - \psi < \phi < 2\pi/3 + \psi \\ 0 & 4\pi/3 - \psi < \phi < 4\pi/3 + \psi \end{cases} \tag{31}$$

$$E_{z1}^{out} = -E_{z2}^{out} \tag{32}$$

$$H_{\phi 1}^{out} = H_{\phi 2}^{out} \tag{33}$$

If the field distribution has satisfied the previous conditions, the Poynting vectors at port 1 and port 2 are given by Equations (33A) and (33B) respectively. The natural behavior of the resonator leads to having a zero tangential magnetic field at the disc surface. The disc surface can be approximately modeled as PMC surface due to the relatively high dielectric constant of ferrites ($\varepsilon_r$>10 for most of ferrites). This point will be revisited later as this condition is very critical in the circulator design procedure. In order to apply the circulator boundary condition of the magnetic field, the magnetic field outside the disc should be obtained. The field distribution outside the ferrite disc is basically a function of the feeding structure of the center junction. In the case of the stripline both fields can be expressed by Equations (34) and (35) respectively.

$$\overline{P}_1 = E_{z1}^{out}\hat{a}_z \times H_{\varnothing 1}^{out}\hat{a}_{\varnothing} = -\hat{a}_p P_0 \tag{33A}$$

$$\overline{P}_2 = -E_{z1}^{out}\hat{a}_z \times H_{\varnothing 1}^{out}\hat{a}_{\varnothing} = \hat{a}_p P_0 \tag{33B}$$

$$E_z = \begin{cases} -\sum_{m\ odd} \frac{2}{m\pi} \frac{\sin\left(\left(\frac{m\pi}{2\sqrt{3}}\right)\psi\right)}{\varepsilon \cosh\left(\frac{m\pi h}{W_p}\right)} \cos\left(\frac{m\pi}{2\sqrt{3}}\phi\right) \cosh\left(\frac{m\pi}{W_p}(z-h)\right) & (A) \\ \sum_{m\ odd} \frac{2}{m\pi} \frac{\sin\left(\left(\frac{m\pi}{2\sqrt{3}}\right)\psi\right)}{\varepsilon \cosh\left(\frac{m\pi h}{W_p}\right)} \cos\left(\frac{m\pi}{2\sqrt{3}}\phi\right) \cosh\left(\frac{m\pi}{W_p}(h-z)\right) & (B) \\ \sum_{m\ odd} \frac{2}{m\pi} \frac{\sin\left(\left(m\pi/2\sqrt{3}\right)\psi\right)}{\varepsilon \cosh\left(m\pi h/W_p\right)} \cos\left(\frac{m\pi}{2\sqrt{3}}\left(\phi - \frac{2\pi}{3}\right)\right) \cosh\left(\frac{m\pi}{W_p}(z-h)\right) & (C) \\ -\sum_{m\ odd} \frac{2}{m\pi} \frac{\sin\left(\left(\frac{m\pi}{2\sqrt{3}}\right)\psi\right)}{\varepsilon \cosh\left(\frac{m\pi h}{W_p}\right)} \cos\left(\frac{m\pi}{2\sqrt{3}}\left(\phi - \frac{2\pi}{3}\right)\right) \cosh\left(\frac{m\pi}{W_p}(z-h)\right) & (D) \end{cases} \tag{34}$$

$(A)\ 0 > z > -h,\ \psi > \phi > -\psi$ $(C)\ 0 > z > -h,\ \frac{2\pi}{3} + \psi > \phi > \frac{2\pi}{3} - \psi$ $(B)\ h > z > 0,\ \psi > \phi > -\psi$ $(D)\ h > z > 0,\ \frac{2\pi}{3} + \psi > \phi > \frac{2\pi}{3} - \psi$ $$E_z = \tag{35}$$

$$\begin{cases} -\sum_{m\ odd} \frac{2Y_0}{m\pi} \frac{\sin\left(\left(\frac{m\pi}{2\sqrt{3}}\right)\psi\right)}{\varepsilon \cosh\left(\frac{m\pi h}{W_p}\right)} \cos\left(\frac{m\pi}{2\sqrt{3}}\phi\right) \cosh\left(\frac{m\pi}{W_p}(z-h)\right) & (A) \\ \sum_{m\ odd} \frac{2Y_0}{m\pi} \frac{\sin\left(\left(\frac{m\pi}{2\sqrt{3}}\right)\psi\right)}{\varepsilon \cosh\left(\frac{m\pi h}{W_p}\right)} \cos\left(\frac{m\pi}{2\sqrt{3}}\phi\right) \cosh\left(\frac{m\pi}{W_p}(h-z)\right) & (B) \\ -\sum_{m\ odd} \frac{2Y_0}{m\pi} \frac{\sin\left(\left(\frac{m\pi}{2\sqrt{3}}\right)\psi\right)\cos\left(\phi - \frac{2\pi}{3}\right)}{\varepsilon \cosh\left(m\pi h/W_p\right)} \cos\left(\frac{m\pi}{2\sqrt{3}}\left(\phi - \frac{2\pi}{3}\right)\right) \cosh\left(\frac{m\pi}{W_p}(z-h)\right) & (C) \\ \sum_{m\ odd} \frac{2Y_0}{m\pi} \frac{\sin\left(\left(\frac{m\pi}{2\sqrt{3}}\right)\psi\right)\cos\left(\phi - \frac{2\pi}{3}\right)}{\varepsilon \cosh\left(\frac{m\pi h}{W_p}\right)} \cos\left(\frac{m\pi}{2\sqrt{3}}\left(\phi - \frac{2\pi}{3}\right)\right) \cosh\left(\frac{m\pi}{W_p}(z-h)\right) & (D) \end{cases}$$

$(A)\ 0 > z > -h,\ \psi > \phi > -\psi$ $(C)\ 0 > z > -h,\ \frac{2\pi}{3} + \psi > \phi > \frac{2\pi}{3} - \psi$ $(B)\ h > z > 0,\ \psi > \phi > -\psi$ $(D)\ h > z > 0,\ \frac{2\pi}{3} + \psi > \phi > \frac{2\pi}{3} - \psi$ The detailed derivation of Equations (34) and (35) is given in Appendix A. This implements the existence of the magnetic field at ports 1 and 2 while ensuring the nonexistence of the magnetic field at port 3. This ideal field boundary condition can be satisfied only by having an infinite number of modes. Comparing Equations (28) and (35) the amplitude $A_n$ can be expressed by Equation (36) where $x=k_{eff}a$. By straight forward manipulation, exactly at the middle of the structure, it can be obtained given by Equation (36) and (37) where $I_1(\psi, m, n)$ is defined by Equation (38).

$$A_n = j\frac{1}{Y_{0eff}}\left[\frac{1}{J_n'(x) + \frac{ng_\kappa}{x}J_n(x)}\right] * \frac{1}{2\pi}\int_{-\pi}^{\pi} H_\phi^{out} e^{-jn\phi} d\phi \tag{36}$$

$$A_n = j\frac{1}{Y_{0eff}}\left[\frac{1 + e^{-j2\pi n/3}}{J_n'(x) + \frac{ng_\kappa}{x}J_n(x)}\right] * \left(\frac{2Y_0}{\varepsilon}\right)\sum_{m\ odd} \frac{\sin\left(\left(m\pi/2\sqrt{3}\right)\psi\right)}{2m} * I_1(\psi, m, n) \tag{37}$$

-continued $$I_1(\psi, m, n) = \int_{-\psi}^{\psi} \cos\left(\frac{m\pi}{2\sqrt{3}}\phi\right)\cos(\phi)e^{-jn\phi}d\phi \tag{38}$$

The effect, characteristic admittance can be written as Equations (39) and (40) where $\eta_0=\sqrt{\mu_0/\epsilon_0}$ and the effective characteristic impedance can be expressed as Equation (41).

$$1/Y_{0eff} = \sqrt{\mu_{eff}/\varepsilon} = \eta_{eff_r}\cdot\eta_0 \tag{39}$$

$$x = k_{eff}a \tag{40}$$

$$\eta_{eff_r} = \sqrt{\frac{\mu_{eff}/\mu_0}{\varepsilon_r}} \tag{41}$$

Substituting into Equation (27), the electric field can be written as given by Equation (42). The electric field at the port can be obtained by calculating the average value of this field in the interval around the port while substituting at p=a. This can be expressed as Equation (43) where $\phi_P$=120° or 240°. Performing the integral the average electric field at the port yields Equation (44). Equation (44) can then be written in a compact form as given by Equation (45) where $f_n(x, g_k)$ is given by Equation (46).

$$E_z = \sum j\eta_{eff_r}\cdot\eta_0\left[\frac{(1+e^{-j2\pi n/3})J_n(k_{eff}(\rho))}{J_n'(x)+\frac{ng_k}{x}J_n(x)}\right]e^{jn\phi} * \left(\frac{2Y_0}{\varepsilon}\right)\sum_{m\ odd}\frac{\sin\left(\left(m\pi/2\sqrt{3}\right)\psi\right)}{2m} * I_1(\psi, m, n) \tag{42}$$

$$E_{zp} = \frac{1}{2\psi}\int_{\phi_p-\psi}^{\phi_p+\psi} E_z d\phi\Big|_{\rho=a} \tag{43}$$

$$E_z = \sum j\eta_{eff_r}\cdot\eta_0\left(\frac{\sin(n\psi)}{n\psi}\right)\left[\frac{(1+e^{-j2\pi n/3})J_n(k_{eff}(\rho))}{J_n'(x)+\frac{ng_k}{x}J_n(x)}\right]e^{jn\phi} * \left(\frac{2Y_0}{\varepsilon}\right)\sum_{m\ odd}\frac{\sin\left(\left(m\pi/2\sqrt{3}\right)\psi\right)}{2m} * I_1(\psi, m, n) \tag{44}$$

$$E_z = \sum j\eta_{eff_r}\cdot\eta_0\left(\frac{\sin(n\psi)}{n\psi}\right)\left[\frac{(1+e^{-j2\pi n/3})}{f_n(x, g_k)}\right]e^{jn\phi} * \left(\frac{2Y_0}{\varepsilon}\right)\sum_{m\ odd}\frac{\sin\left(\left(m\pi/2\sqrt{3}\right)\psi\right)}{2m} * I_1(\psi, m, n) \tag{45}$$

$$f_n(x, g_k) = \frac{J_n'(x)}{J_n(x)} + \frac{ng_k}{x} \tag{46}$$

The previous equations are obtained by applying the boundary conditions of the tangential magnetic fields only. In most of the published work, this is a turning point, where the junction impedance is evaluated. The equations till this point contain three unknowns $g_k$, x and ψ. The value of $g_k$ is related to the magnetic biasing point of the ferrite disc and the saturation magnetic value of the used ferrite. The other two parameters (x and ψ) determine the physical dimensions of the circulator. These two parameters refer to the ferrite disc radius and the stripline width respectively. It is normal to assume the value of $g_k$ as a first step of the design. This value should be selected from 0 to −1 for below resonance mode of operation. Actually, it should be in between −0.2 and −0.8 to avoid losses due to resonance mode or below the saturation mode. This choice will be addressed in details subsequently. The design procedure established by the inventors is based on the below resonance mode of operation. However, it can be modified to design in the above resonance mode. The majority of the circulator designers within the prior continue with their design procedures based upon calculating the junction impedance and equating the imaginary part of the junction impedance by zero to ensure the isolation in the design. In fact, this provides one equation in two unknowns, x and ψ: This complicates the procedure to reach the required dimension of the circulator.

Accordingly, to the inventors, it is evident that there are missing boundary conditions to be applied. The electric field at the input port should have the same magnitude of the coupled port with a 180° phase shift, while the field at the isolated port should be equal to zero. These conditions can be listed as Equations (47) and (48) respectively. After straightforward manipulations, two governing equations can be obtained to satisfy the circulator conditions. These two equations will be referred to as the "Circulator Ergodic Equations" and are given by Equations (49) and (50), respectively.

$$E_{zp1}\big|_{\phi=0} = -E_{zp2}\big|_{\phi=\frac{2\pi}{3}} \tag{47}$$

$$E_{zp3}\big|_{\phi=\frac{4\pi}{3}=\frac{-2\pi}{3}} = 0 \tag{48}$$

$$\sum_{n=-\infty}^{\infty}\left[\frac{\sin(n\psi)}{n\psi}\right]\frac{\cos(2\pi n/3)}{f_n(x, g_k)}\sum_{m\ odd}\frac{\sin\left(\left(m\pi/2\sqrt{3}\right)\psi\right)}{2m} * I_1(\psi, m, n) = 0 \tag{49}$$

$$\sum_{n=-\infty}^{\infty}\left[\frac{\sin(n\psi)}{n\psi}\right]\frac{1}{f_n(x, g_k)}\sum_{m\ odd}\frac{\sin\left(\left(m\pi/2\sqrt{3}\right)\psi\right)}{2m\pi^2} * I_1(\psi, m, n) = 0 \tag{50}$$

The integral can be evaluated as it is illustrated in Appendix A. In order to simplify the solution of the ergodic equations, uniform excitation at the coupling area can be utilized to yield the simpler expressions in Equations (51) and (52).

$$\sum_{n=-\infty}^{\infty}\left[\frac{\sin(n\psi)}{n\psi}\right]\frac{\cos(2\pi n/3)}{f_n(x, g_k)} = 0 \tag{51}$$

$$\sum_{n=-\infty}^{\infty}\left[\frac{\sin(n\psi)}{n\psi}\right]\frac{1}{f_n(x, g_k)} = 0 \tag{52}$$

Using the ergodic equations, the physical dimensions of the circulator can be obtained through solving two nonlinear equations in two unknowns. In order to achieve this, one of several iterative techniques can be used, where the initial values of both variables can be selected with relative ease. The expected value of ψ should be less than π/3, hence a good starting point is π/6 in the iterative solution. In some cases, the iterative algorithm fails to find the required solution because of the initial point. In such cases, the initial guess should be changed and the iterative algorithm has to be repeated.

3. Evaluation of Design Procedures within the Prior Art

The previous analysis yielded the ergodic equations of the junction circulators. These equations can be used to evaluate prior art design procedures. The analysis presented in this section can be divided into two categories. The first category is based on considering only three terms of the series n=0, 1 and −1, while the second category of circulator design procedures had taken into consideration up to n=±3. In the following part, both techniques are going to be criticized based on the previous analysis. Hence, an overview of the recent progress in the circulator analysis and design is discussed.

3.1 Low Magnetic Bias Junction Circulators

This design procedure was originally by Bosma in "On Stripline Y-Circulation at UHF" (IEEE Microwave Theory and Techniques, Vol. 12, No. 1, pp. 61-72) and was further developed by Fay and Comstock in "On the Theory of the Ferrite Junction Circulator" (Int. Symp. Professional Technical Group on Microwave Theory and Techniques, Vol. 64, No. 1, pp. 54-59) and "Operation of the Ferrite Junction Circulator" (IEEE Microwave Theory and Techniques, Vol. 13, No. 1, pp. 15-27). These researchers assumed that all terms with n>1 have a small contribution and can be neglected. In this design procedure, three terms only of the series are considered, n={0, 1, −1}. The selected solution is the one that gives resonance under no bias. This resulted in $\grave{J}_1(k_{eff}a)=0$ as mentioned in their analysis. To evaluate the validity of this assumption, the inventors consider only the first three terms in Equations (49) and (50). These can be written as Equations (53) and (54) respectively.

$$0 = \frac{\sum_{m\ odd} \frac{\sin\left(\left(m\pi/2\sqrt{3}\right)\psi\right)}{2m\pi^2} * I_1(\psi, m, 0)}{\frac{J_0'(x)}{J_0(x)}} - \frac{\left(\frac{1}{2}\right)\left(\frac{\sin(\psi)}{\psi}\right)^2 \sum_{m\ odd} \frac{\sin\left(\left(m\pi/2\sqrt{3}\right)\psi\right)}{2m\pi^2} * I_1(\psi, m, 1)}{\frac{J_1'(x)}{J_1(x)} + \frac{g_\kappa}{x}} - \frac{\left(\frac{1}{2}\right)\left(\frac{\sin(\psi)}{\psi}\right)^2 \sum_{m\ odd} \frac{\sin\left(\left(m\pi/2\sqrt{3}\right)\psi\right)}{2m\pi^2} * I_1(\psi, m, -1)}{\frac{J_{-1}'(x)}{J_{-1}(x)} + \frac{g_\kappa}{x}} \tag{53}$$

$$0 = \frac{\sum_{m\ odd} \frac{\sin\left(\left(m\pi/2\sqrt{3}\right)\psi\right)}{2m\pi^2} * I_1(\psi, m, 0)}{\frac{J_0'(x)}{J_0(x)}} - \frac{\left(\frac{\sin(\psi)}{\psi}\right)^2 \sum_{m\ odd} \frac{\sin\left(\left(m\pi/2\sqrt{3}\right)\psi\right)}{2m\pi^2} * I_1(\psi, m, 1)}{\frac{J_1'(x)}{J_1(x)} + \frac{g_\kappa}{x}} - \frac{\left(\frac{\sin(\psi)}{\psi}\right)^2 \sum_{m\ odd} \frac{\sin\left(\left(m\pi/2\sqrt{3}\right)\psi\right)}{2m\pi^2} * I_1(\psi, m, -1)}{\frac{J_{-1}'(x)}{J_{-1}(x)} + \frac{g_\kappa}{x}} \tag{54}$$

It can be proved that $I_1(\psi, m, 1)=I_1(\psi, m, -1)$. Hence, using the identities in Table 2, the previous expressions can be written as Equations (55)/(56) and (57)/(58) respectively.

$$0 = \left(\frac{J_0(x)}{J_1(x)}\right) \sum_{m\ odd} \frac{\sin\left(\left(m\pi/2\sqrt{3}\right)\psi\right)}{2m\pi^2} * I_1(\psi, m, 0) \tag{55}$$

$$+\left(\frac{\sin(\psi)}{\psi}\right)^2 \frac{J_1'(x)/J_1(x)}{\left(\frac{J_1'(x)}{J_1(x)}\right)^2 - \left(\frac{g_\kappa}{x}\right)^2} \sum_{m\ odd} \frac{\sin\left(\left(m\pi/2\sqrt{3}\right)\psi\right)}{2m\pi^2} * I_1(\psi, m, 1) \tag{56}$$

$$0 = \left(\frac{J_0(x)}{J_1(x)}\right) \sum_{m\ odd} \frac{\sin\left(\left(m\pi/2\sqrt{3}\right)\psi\right)}{2m\pi^2} * I_1(\psi, m, 0) \tag{57}$$

$$-2 * \left(\frac{\sin(\psi)}{\psi}\right)^2 \frac{J_1'(x)/J_1(x)}{\left(\frac{J_1'(x)}{J_1(x)}\right)^2 - \left(\frac{g_\kappa}{x}\right)^2} \sum_{m\ odd} \frac{\sin\left(\left(m\pi/2\sqrt{3}\right)\psi\right)}{2m\pi^2} * I_1(\psi, m, 1) \tag{58}$$

TABLE 2

Some Bessel Function Identities

| Expression | Equivalent |
|---|---|
| $J_0'(x)$ | $-J_1(x)$ |
| $J_{-n}(x)$ | $(-1)^n J_{-n}(x)$ |
| $J_{-n}'(x)$ | $(-1)^n J_{-n}'(x)$ |
| $J_{-n}'(x)/J_{-n}(x)$ | $J_{-n}'(x)/J_{-n}(x)$ |

Hence, both expressions can be written as Equations (59) and (60).

$$[J_1'(x)]^2 + \left(\frac{\sin(\psi)}{\psi}\right)^2 \left(\frac{J_1^2(x)}{J_0(x)}\right) \frac{\sum_{m\ odd} \frac{\sin\left(\left(m\pi/2\sqrt{3}\right)\psi\right)}{2m\pi^2} * I_1(\psi, m, 1)}{\sum_{m\ odd} \frac{\sin\left(\left(m\pi/2\sqrt{3}\right)\psi\right)}{2m\pi^2} * I_1(\psi, m, 0)} J_1'(x) - \left(\frac{g_\kappa}{x}\right)^2 (J_1(x))^2 = 0 \tag{59}$$

$$[J_1'(x)]^2 - 2\left(\frac{\sin(\psi)}{\psi}\right)^2 \left(\frac{J_1^2(x)}{J_0(x)}\right) \frac{\sum_{m\ odd} \frac{\sin\left(\left(m\pi/2\sqrt{3}\right)\psi\right)}{2m\pi^2} * I_1(\psi, m, 1)}{\sum_{m\ odd} \frac{\sin\left(\left(m\pi/2\sqrt{3}\right)\psi\right)}{2m\pi^2} * I_1(\psi, m, 0)} J_1'(x) - \left(\frac{g_\kappa}{x}\right)^2 (J_1(x))^2 = 0 \tag{60}$$

It is very clear that these two equations are contradicting. They cannot be solved together. However, the solution provided by Bosma was $\grave{J}_1(x)=0$ which leads to have x=1.841. It is recommended in the design based on their solution is to select a small value for $g_\kappa(=k/\mu)$. This can be predicted easily by a quick look to the provided solution. As long as $\grave{J}_1(x)=0$ the condition that should be satisfied is given by Equation (61). By substituting x=1.841 we obtain Equation (62).

$$\left(\frac{g_\kappa}{x}\right)^2 (J_1(x))^2 = 0 \tag{61}$$

$$0.099\, g_\kappa^2 = 0 \tag{62}$$

This condition will never be satisfied, which means that considering three terms only are not a suitable solution for the problem. On the other hand, by having a small value for k/μ, the design results in an operating circulator even with a poor performance. That is why they have recommended a range of k/μ to be less than 0.5. The insufficient number of terms in the analysis resulted in inaccurate approximation. This fact was discovered within the prior art, but without a proper explanation. In the following subsection, the modified design methodologies by considering seven terms of the series is criticized.

3.2 Tracking and Semi-Tracking Solution for Junction Circulators

The presented work by Bosma, Fay, and Comstock was modified subsequently by Helszajn in "Synthesis of Quarter-Wave Coupled Circulators with Chebyshev Characteristics" (IEEE Microwave Theory and Techniques, Vol. 20, No. 11, pp. 764-769) to include up to n=±3. This design procedure was developed within the prior art for several cases by Helszajn. In the analysis provided by Helszajn, the magnetic field boundary conditions were applied before the port impedance is calculated and equated to zero at the center frequency of the design. After assuming $g_k$, this leads to have one equation in two unknowns, x and ψ. Helszajn also splits the circulator design into two groups: the weekly magnetized (small value for k/μ) and the tracking circulator (higher values for k/μ). Although the work performed by Helszajn provides a design with improved performance in the then prior art it still suffers limitations such as evaluating only seven terms which deteriorates the accuracy of the provided solution. Moreover, the solution does not pay attention to the realistic field distribution at the feeding structure. Further, there are two other limitations as the methodology has a single equation in two unknowns and is based on the assumption of having a zero tangential magnetic field outside the disc. The realistic magnetic field, however, is attenuated radially outside the disc, but is non-zero. This can be implemented by a modified Bessel function in the regions among the ports. The fringing fields result in a larger electrical radius of the disc, which shifts the measured frequency response with respect to the design. In many stripline circulators, the stripline has to be filled with a dielectric. Whilst this aids in achieving the required impedance matching and provides a mechanical support for the stripline it violates more and more of the PMC assumptions at the boundary between the ferrite disc and the surrounding material.

3.2.1 Modified Seven Term Based Solution

A simple modification can be performed by just considering the first seven terms in the series in the ergodic equation. Accordingly, applying in these equations n=0, ±1, ±2, ±3 the expressions given in Equations (63) and (64) are obtained where the function $T_n(\psi, x, g_k)$ is defined as a twin function to consider two opposite rotating modes of the same order as defined in FIG. 65). Solving Equations (63) and (64) together leads to Equations (66) and (67).

$$T_0(\psi, x, g_\kappa) - \frac{1}{2}T_1(\psi, x, g_\kappa) - \frac{1}{2}T_2(\psi, x, g_\kappa) + T_3(\psi, x, g_\kappa) = 0 \tag{63}$$

$$T_0(\psi, x, g_\kappa) + T_1(\psi, x, g_\kappa) + T_2(\psi, x, g_\kappa) + T_3(\psi, x, g_\kappa) = 0 \tag{64}$$

-continued $$T_n(\psi, x, g_\kappa) = \begin{cases} \left(\frac{\sin(n\psi)}{\psi}\right)\left(\frac{2J_n'(x)/J_n(x)}{(J_n'(x)/J_n(x))^2 - (ng_\kappa/x)^2}\right) \\ \sum_{m\ odd} \frac{\sin\left(\left(m\pi/2\sqrt{3}\right)\psi\right)}{2m\pi^2} * I_1(\psi, m, 1) & n \neq 0 \\ \frac{\sum_{m\ odd} \frac{\sin\left(\left(m\pi/2\sqrt{3}\right)\psi\right)}{2m\pi^2} * I_1(\psi, m, 0)}{} \\ -J_0(x)/J_1(x) & n = 0 \end{cases} \tag{65}$$

$$T_1(\psi, x, g_\kappa) + T_2(\psi, x, g_\kappa) = 0 \tag{66}$$

$$T_0(\psi, x, g_\kappa) + T_3(\psi, x, g_\kappa) = 0 \tag{67}$$

In spite of that the previous equations consider the only 7 terms of the series (n=0, ±1, ±2, ±3) but, it is able to provide a better accuracy. Here, the stripline field distribution in the coupling area are considered. Moreover, the solution to the provided equations is straightforward as it is based on solving two nonlinear equations in two unknowns.

3.3 Recent Developments in Circulators

During the last decade whilst there have been many publications within the prior art these have predominantly addressed deploying circulators in different applications or introduced new performance evaluation methodologies. Within this, many researchers are directed to implement the circulator functions through active elements. Yet, in contrast, relatively minimal attention has been given to the actual development of the basic analysis of the circulators despite the massive increase in their deployment with the penetration of wireless technologies into nearly every aspect of our lives. The junction circulators utilized in the recent publications are predominantly based upon the traditional methods presented 50 years ago. Within the preceding sections whilst the inventors have given an indication of the major research directions in this field in recent years and whilst there is work directed to the analysis of the circulator, see for example Porranzl et al. in "A New Active Quasi-Circulator Structure with High Isolation for 77-GHz Automotive FMCW Radar Systems in SiGe Technology" (IEEE Compound Semiconductor Integrated Circuit Symposium 2015, pp. 1-4) and Kim et al. in "Three Octave Ultra-Wideband 3-Port Circulator in 0.11 mm CMOS" (Electronics Letters, Vol. 49, No. 10, pp. 648-650). However, even this prior art is more focused on enhancing the old analysis by including some new parameters rather than addressing and revising the major steps in the analysis.

4. The Junction Immittance & Scattering Matrix

The junction circulator is a N-port network, however, the most commonly used configuration is the three port circulator, N=3. The port electric field and magnetic field based on the previous analysis supra can be expressed as Equations (68) and (69) respectively. The previous equation of the magnetic field at the port is obtained through the integration as defined in Equation (70) and the electric and magnetic fields are related to each other through the matrix relationship given in Equation (71). Based on symmetry the statement in Equation (72) can be written.

$$E_{zp} = \sum_n jn_{eff_r} \cdot n_0 \left(\frac{\sin(n\psi)}{\psi}\right)\left[\frac{1+e^{-j\frac{2\pi n}{3}}}{f_n(x, g_K)}\right] e^{jn\phi_p} \cdot \left(\frac{2Y_o}{\varepsilon}\right)\sum_{m\ odd} \frac{\left(\sin\left(\left(m\pi/2\sqrt{3}\right)\psi\right)\right)}{2m\pi^2} I_1(\psi, m, n) \tag{68}$$

$$H_{\phi p1} = \left(\frac{2Y_o}{\varepsilon}\right)\sum_{m\ odd} \frac{\sin\left(\left(m\pi/2\sqrt{3}\right)\psi\right)}{2m\pi^2} I_1(\psi, m, 0) \tag{69}$$

$$H_{\phi p} = \frac{1}{2\psi}\int_{\phi_p-\psi}^{\phi_p-\psi} H_\phi d\phi\Big|_{\rho=a} \tag{70}$$

$$\begin{bmatrix} E_{zp1} \\ E_{zp2} \\ E_{zp3} \end{bmatrix} = \begin{bmatrix} \eta_{11} & \eta_{12} & \eta_{13} \\ \eta_{21} & \eta_{22} & \eta_{23} \\ \eta_{31} & \eta_{32} & \eta_{33} \end{bmatrix} \begin{bmatrix} H_{\phi p1} \\ H_{\phi p2} \\ H_{\phi p3} \end{bmatrix} \tag{71}$$

$$\eta_{11} = \eta_{22} = \eta_{23} \tag{72}$$

In addition, for the circulator operation, the cyclic symmetry requirement is a necessary condition. This can be formalized as Equations (73) and (74). This reduces the number of unknowns in the previously mentioned matrix representations to the given Equations (75) and (76).

$$\eta_{12} = \eta_{31} = \eta_{23} \tag{73}$$

$$\eta_{13} = \eta_{21} = \eta_{32} \tag{74}$$

$$[E_{zp}] = [\eta_{3\times3}][H_{\phi p}] \tag{75}$$

$$\begin{bmatrix} E_{zp1} \\ E_{zp2} \\ E_{zp3} \end{bmatrix} = \begin{bmatrix} \eta_{11} & \eta_{12} & \eta_{13} \\ \eta_{13} & \eta_{11} & \eta_{12} \\ \eta_{12} & \eta_{13} & \eta_{11} \end{bmatrix} \begin{bmatrix} H_{\phi p1} \\ H_{\phi p2} \\ H_{\phi p3} \end{bmatrix} \tag{76}$$

The intrinsic impedance matrix elements can be calculated from Equations (77) to (79) respectively. For the circulator to operate in the required manner, the electric field and the magnetic field at the isolated port, both, have to be equal to zero simultaneously. The input intrinsic impedance of the junction can be written as Equation (80).

$$\eta_{11} = \sum\left[j\frac{\eta_{eff}\cdot\eta_0\psi}{\pi}\right]\left(\frac{\sin(n\psi)}{\psi}\right) \frac{\frac{1}{f_n(x, g_k)}\sum_{m\ odd}\frac{\sin\left(\left(m\pi/2\sqrt{3}\right)\psi\right)}{m\pi} * I_1(\psi, m, n)}{\sum_{m\ odd}\frac{\sin\left(\left(m\pi/2\sqrt{3}\right)\psi\right)}{m\pi} * I_1(\psi, m, 0)} \tag{77}$$

$$\eta_{12} = \sum\left[j\frac{\eta_{eff}\cdot\eta_0\psi}{\pi}\right]\left(\frac{\sin(n\psi)}{\psi}\right) \frac{\frac{e^{-j2n\pi/3}}{f_n(x, g_k)}\sum_{m\ odd}\frac{\sin\left(\left(m\pi/2\sqrt{3}\right)\psi\right)}{m\pi} * I_1(\psi, m, n)}{\sum_{m\ odd}\frac{\sin\left(\left(m\pi/2\sqrt{3}\right)\psi\right)}{m\pi} * I_1(\psi, m, 0)} \tag{78}$$

-continued $$\eta_{13} = \sum\left[j\frac{\eta_{eff}\cdot\eta_0\psi}{\pi}\right]\left(\frac{\sin(n\psi)}{\psi}\right) \frac{\frac{e^{-j4n\pi/3}}{f_n(x, g_k)}\sum_{m\ odd}\frac{\sin\left(\left(m\pi/2\sqrt{3}\right)\psi\right)}{m\pi} * I_1(\psi, m, n)}{\sum_{m\ odd}\frac{\sin\left(\left(m\pi/2\sqrt{3}\right)\psi\right)}{m\pi} * I_1(\psi, m, 0)} \tag{79}$$

$$\eta_{in} = \eta_{11} - \eta_{12}^2/\eta_{13} \tag{80}$$

To determine the impedance representation of the junction, the term $\eta_0$ has to be replaced by $z_0$, where $z_0$ represents the characteristic impedance of the input transmission line at the junction port. This also provides the normalized impedance representation relative to the port impedance.

As the junction design aims to satisfy the ergodic equations at the operating center frequency, the frequency response of the junction admittance should be considered to obtain the matching within the objective bandwidth. Solving the ergodic circulator equations results in having $g_k$, $\psi$ and x. This defines the material specifications and the dimensions. Hence, the input impedance of this specified ferrite disc can be plotted with respect to frequency in order to design the suitable matching network. The scattering parameters can be obtained through the impedance representation through Equation (81).

$$[S] = \left(\frac{Z_r}{\eta_0}[\eta] + [I]\right)^{-1}\left(\frac{Z_r}{\eta_0}[\eta] - [I]\right) \tag{81}$$

5. Design Procedure for Stripline Circulators

The circulator specifications are defined by the operating frequency band and the required matching and isolation levels. Starting with these specifications, the design frequency is calculated. The inventor's design procedure splits the process into two major steps. The first step is to solve at the design frequency, which results in selecting the required parameters for which the ergodic circulator equations are satisfied. Then, the second step is to design the matching transformer to cover the required bandwidth. The deployed matching methodology of the inventors is to change the characteristic impedance of the feeding structure through a dielectric filling. This matching technique is able to provide both the required matching but also contributes to cooling the ferrite discs which in turns allow for increased the overall power handling capability of the structure. Finally, the necessary effective permittivity for the structure is achieved through the use of a perforated substrate. The perforations allowed a standard substrate dielectric constant to be reduced to the desired design value. Further, embodiments of the invention place the design frequency offset from the middle frequency in between the two band edges as the fringing fields within the structure result in an increased effective "electrical" diameter of the center disc relative to its physical diameter. Within the prior art, such fringing fields have typically been ignored. In contrast, the design methodology of the inventors employs three design considerations to compensate for their presence and effects.

First, the inventors employ a surrounding dielectric material that has a dielectric constant less than 60% of the ferrite dielectric constant. This decreases to some extent the fringing fields outside the ferrite disc. As the inventor's selected matching technique depends upon changing the relative permittivity of the filler material for the stripline this requirement places, typically, an upper maximum value for the relative permittivity.

Second, the design frequency is typically set to a frequency higher than the middle frequency of the target operating frequency range via a scaling factor, e.g. 5% such that $$f_{CENTRE}=\text{ScalingFactor}\times((f_{LOWER}+f_{UPPER})/2)=1.05\times((f_{LOWER}+f_{UPPER})/2).$$

Third, the hole/recess within the structure is larger than the ferrite disc in order to introduce an air gap around the ferrite disc between it and the surrounding material. This reduces the fringing fields significantly within the portion of the ferrite disc within the surrounding medium. Within the prior art, the design goal has been the elimination of any air gaps to ensure good contact between the ferrite and the surrounding medium. The American National Standards Institute (ANSI) within Standard ANSI 4.1 defines the tolerance for an interference fit (Class V) between a hole and shaft for a nominal 0.125" (3.175 mm) diameter has the hole specified with 0.1244"±0.0004" (3.160±0.010 mm) and the shaft specified as 0.1252"±0.0002" (3.180±0.005 mm). However, even these standard design tolerances are below that of typical Computer Numerical Control (CNC) cutting tools within commercial machine shops which are typically are typically within the range of 0.001" (approx. 25 μm) to 0.0005" (approx. 13 μm). Rather the inventors re-formulate this to being that the goal is to ensure full contact between the ferrite disc and the electrical transmission lines at the ports of the circulator.

Taking these considerations into account, the circulators designed by the inventors meet the required circulator specifications. The analysis of the ferrite resonator can be modified to include the fringing fields outside the ferrite resonator (disc) by representing these fringing fields with a modified Bessel function and applying the appropriate boundary conditions. The mathematical formulation can be modified, but, practically, it is extremely hard to ensure the contact between the disc and the surrounding material over the whole perimeter as noted supra for typical high volume commercial machining tolerances. Accordingly, the inventors reformulated design forces the existence of air and included it in the design analysis.

5.1 Step 1: The Ferrite Disc Design

The first step aims to identify the center material fully. The outcome of this step is to choose the required magnetic saturation point of the ferrite material, i.e.: the value of $4\pi M_s$ as well as the applied external magnetic field. Then, the disc radius and the coupling angle are determined. This is performed through the following procedure.

Step 1A: The design frequency can be obtained from both band edges, following the considerations described supra, through Equation (82) wherein the scaling factor offsets the design center frequency. For example, the inventors within the design, analysis employ ScalingFactor=1.05, i.e. a 5% offset.

$$f_{CENTRE}=\text{ScalingFactor}\times((f_{LOWER}+f_{UPPER})/2) \quad (82)$$

Step 1B: Next the ferrite material is selected. This begins with the assumption of the Gytropy $g_k$, which the inventors have established as $0.2\leq g_K\leq 0.8$, and a magnetic biasing ratio α. Based upon these the magnetic saturation is calculated from the Gytropy value using Equation (7). The assumed value of α defines the magnetic biasing circuit after building the circulator, as it relates the magnetic saturation of the ferrite with the applied the magnetic field $H_0(O_e)=*\alpha$. The inventors within their analysis typically limit this to $0\leq\alpha\leq 0.5$ as higher values result in above saturation losses whilst negative values result in low field losses. Generally, in the magnetic biasing circuit design, the demagnetization factor should be taken into account. This concept is addressed within the prior art. In the examples presented the inventors have employed a thin disc physical configuration, which has an approximate unity demagnetization factor. Accordingly, no detailed study will be given to this concept here, however, it is worth to mention that considering this factor accurately, should result in a better design. The inventors being the design process from a certain α as a starting point, typically around 0.2. As discussed supra, assuming this parameter is equal to zero as within the prior art, is not a practical assumption as the DC magnetic field responsible of biasing the ferrite is generated by a permanent magnet. The magnetic field associated with this magnet cannot be controlled in a continuous manner, especially, when there are other constraints such as the behavior with temperature or aging effects of the used magnets. In this specification the inventors perform the design analysis twice, for α=0 and α=0.2

Step 1C: After calculating $4\pi M_s$ and $H_0$, the full permeability tensor can be obtained based on the expressions in Table 1. Accordingly, it is relatively straightforward to obtain $\mu_{eff}$ and $k_{eff}$.

Step 1D: Accordingly, the ergodic circulator equations can be solved yielding values of ψ and x can be obtained. Since $x=k_{eff}$, the radius of the ferrite disc is calculated.

Step 1E: Based upon the radius and the coupling angle the stripline width, can be calculated through Equation (29). Within this analysis, the height of the ferrite disc equals to the height of the stripline. This height can be selected keeping in mind that $h_f<a$. This condition is required in order to ensure small axial variations. It should be noticed that the analysis of the ferrite disc started with neglecting the axial variation. A valid assumption employed by the inventors in their design is that $h_f=0.4*a$.

Accordingly, by working through the previously described points, the ferrite disc for the circulator is fully determined. The material is selected based on the required magnetic saturation value; then the radius is obtained. Finally, the height is assumed within a reasonable range.

5.2 Step 2: Matching Section Design

The second step within the inventor's method according to an embodiment of the invention is to design the feeding structure of the junction. This is considered as a matching network design problem and the selected matching methodology employed here, is simply to perform the matching at the center frequency by the dielectric filling of the stripline.

Step 2A: The directly attached stripline to the ferrite disc has a width W that is calculated in the previous steps. Through the width and the height, the air filled stripline characteristics impedance can be calculated as given by Equation (83) after Pozar where $W_0/b$ is the ratio between the effective width of the line to the total stripline height and $b\approx 2h_f$. The total stripline height is equal to the summation of the top and the bottom ferrite discs neglecting the stripline thickness. This effective ratio is calculated from Equation (84).

$$Z_0 = \frac{30\pi}{W_e/b + 0.441} \tag{83}$$

$$\frac{W_e}{b} = \begin{cases} \frac{W}{b} & \text{for } W/b > 0.35 \\ \frac{W}{b} - \left(0.35 - \frac{W}{b}\right)^2 & \text{for } W/b < 0.35 \end{cases} \tag{84}$$

Step 2B: The input resistance of the junction is calculated at the design frequency. As discussed supra, the imaginary part has to vanish as long as the ergodic circulator equations are satisfied. This reduces the input admittance at the center frequency to be that given in Equation (85). At the center frequency, the circulator conditions are fully satisfied. This results in the condition given by Equation (86) being obtained. This reduces the input resistance equation to be that given by Equation (87).

$$R_{in} = \mathrm{Re}\left\{\frac{Z_0}{\eta_0}(\eta_{11} - \eta_{12}^2/\eta_{13})\right\} \tag{85}$$

$$\eta_{11} = -\eta_{13} \tag{86}$$

$$R_{in} = \mathrm{Re}\left\{\sum\left[j\frac{\eta_{eff}\cdot\eta_0\psi}{\pi}\right]\left(\frac{\sin(n\psi)}{\psi}\right)\frac{1+e^{j2n\pi/3}}{f_n(x, g_k)}\left(\frac{\sum_{m\ odd}\frac{\sin\left(\left(\frac{m\pi}{2\sqrt{3}}\right)\psi\right)}{m\pi} * I_1(\psi, m, n)}{\sum_{m\ odd}\frac{\sin\left(\left(\frac{m\pi}{2\sqrt{3}}\right)\psi\right)}{m\pi} * I_1(\psi, m, 0)}\right)\right. \tag{87}$$

Step 2C: The matching is achieved through a dielectric filling for the stripline. It is important to note that in most cases there is an essential constraint related to the available dielectric constants. The closest available material should be selected for the most feasible matching. It is worth mentioning that the selected standard value for the relative permittivity has to be higher than the design value.

Step 2D: The realization of the final design is carried out through performing perforation inside the selected standard substrate. Through this process, the effective relative permittivity can be extremely close to the design value.

Step 2E: The input admittance frequency dependency has to be considered. This can be found via plotting the input admittance of the junction versus frequency for the selected material within the operating bandwidth. This gives an indication of the expected performance of the matching network.

Step 2F: For the final assessment of the design the scattering parameters can be calculated, over the whole frequency band, from Equation (88).

$$[S] = \left(\frac{Z_r}{\eta_0}[\eta] + [I]\right)^{-1}\left(\frac{Z_r}{\eta_0}[\eta] - [I]\right) \tag{88}$$

It is important to note that using this methodology, the port impedance is forced by the selection of the junction impedance and the coupling angle. This may result in nonstandard values of the stripline characteristic impedance. If the design has to be connected through a standard line, another matching transformer has to be introduced in between the current value and the required standard. This can also achieve by further perforation.

6. Circulator Design Examples

Within this section the inventor's present two designs, one for the K band and the other in X-band.

6.1 Example 1: K-Band Circulator with Perforated Matching Network

6.1A Design #1: $\alpha=0$

In the first example, the frequency band extends from 18 GHz to 26.5 GHz, where the center frequency is at 22.25 GHz. The ferrite material is assumed to have a relative permittivity of "f=12:5. The nominal values for these materials are in the range of 12 to 16.

Step 1: The design frequency in this case is $f_d$=23.363 GHz

Step 2: Assume $g_k$=−0.6, and starting with the exact saturation with $\alpha$=0. The selected material in this case has a magnetic saturation of $4\pi M_s$=5006G. This can be evaluated through Equation (89).

$$4\pi M_s = \frac{f_d}{2.8 * 10^6} p_m \tag{89}$$

Step 3: The magnetic bias in this case is $H_{ext}=4\pi M_s$ this results in $H_0$=0. The values of $\mu_{eff}$ and $k_{eff}$ are $0.64\mu_0$ H/m and 1384 rad/m, respectively.

Step 4: The solution of the ergodic equations provides the values of x and $\psi$ to be 1.5727 and 0.5344, respectively.

Step 5: The ferrite disc radius can be calculated from $x=k_{eff}$ a. The disc radius in this case is a=0.0447 inches (1.135 mm).

Step 6: The stripline width is W=0.0456 inch (1.158 mm);

Step 7: The selected height of the ferrite disc is h=0.4 a=0.0179 inches (0.455 mm).

Step 8: Based on the selected dimensions, the air filled stripline has a characteristic impedance of $Z_{0\ air\ filled}$=146.57Ω

Step 9: The input resistance at resonance is $R_{in}$=43.571Ω

Step 10: The required dielectric constant for the matching is larger than 11 which is not accepted based on the design consideration mentioned previously. The highest recommended value is $\varepsilon_{d,max}=0.6*\varepsilon_f$=7.5. This maximum value will be used in the design of this circulator.

Figure 4:
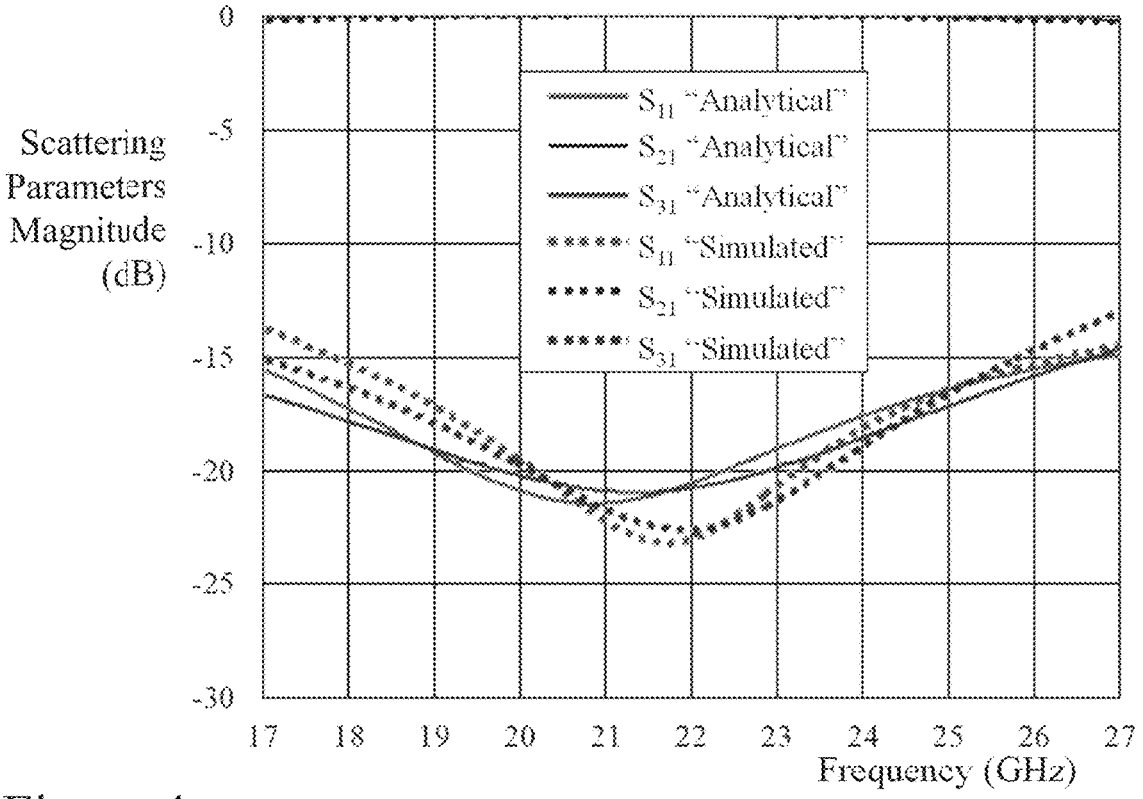
FIG. 4 depicts a comparison between theoretical and simulated responses for the exemplary K-band circulator according to an embodiment of the invention with $\alpha=0$.

Step 11: The scattering parameters are calculated and compared with the simulated results. The simulated model is shown in FIGS. 3A to 3H with both configurations. FIGS. 3A and 3B depict the simulated model for a circulator according to an embodiment of the invention exploiting straight arms in top view and three-dimensional (3D) model, respectively, whilst FIGS. 3C to 3F depict the simulated model according to an embodiment of the invention with curved arms. FIGS. 3G and 3H depict the simulated model for a circulator according to an embodiment of the invention exploiting two curved arms in three-dimensional (3D) model respectively focusing on the Perfect Electrical Conductor (PEC) and Perfect Magnetic Conductor (PMC) boundary conditions respectively. As evident from the Figures, the circulator can be configured with three straight arms or with one straight and two curved arms or other combinations. The waveguide arm curvature is performed to have all ports aligned with the reference planes. This configuration of the circulator is practically preferred in some systems to be connected with different components. FIG. 4 shows a good agreement between the analytical and the simulated response. In this case, the simulated model considers the dielectric constant of the filling material to be exactly equal to the design value regardless the realization of this value.

Figure 5A:
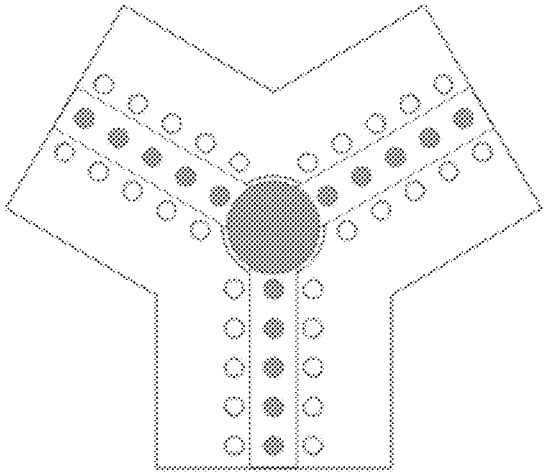
FIGS. 5A and 5B depict the exemplary K-band circulator according to an embodiment of the invention with perforations in plan and 3D views respectively.
Figure 5B:
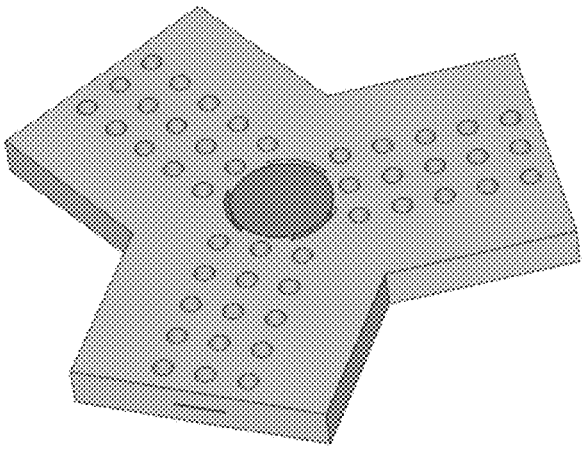
Figure 6:
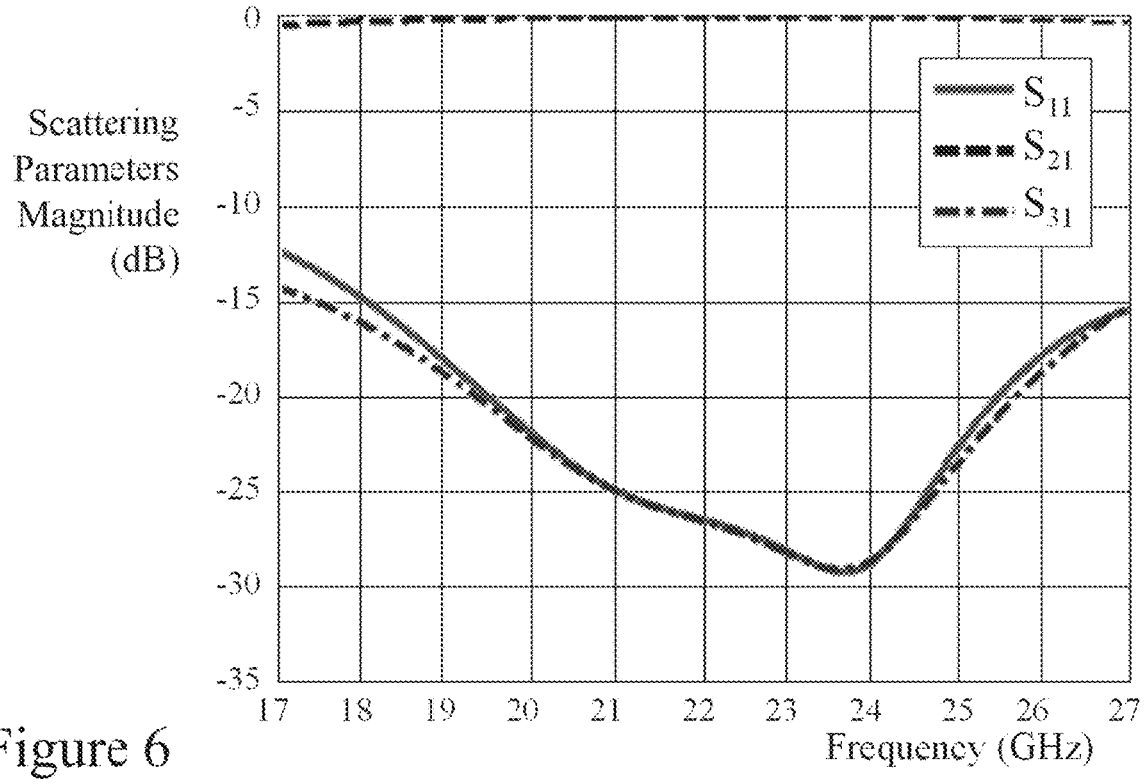
FIG. 6 depicts the scattering parameters for an exemplary K-band circulator according to an embodiment of the invention with perforated matching transformer and $\alpha=0$.

Step 12: Finally, Rogers TMM 10 standard substrate is selected with a relative permittivity of 9.2. The perforation is performed on this substrate to obtain an effective dielectric constant of 7.5, which is the design value. The perforation is defined by two parameters, the hole diameter, and the hole separation. The designed values for both parameters are 0.018 inches and 0.038 inches, respectively. The design procedure of the perforation will be discussed in a separate section. The final configuration is shown in FIGS. 5A and 5B, respectively, with the corresponding response illustrated in FIG. 6.

6.1B Design #1: $\alpha$=0.2

The same example can be solved again, changing the assumption of $\alpha$. In this solution, the value of $\alpha$ is assumed to be 0.2.

Figure 7:
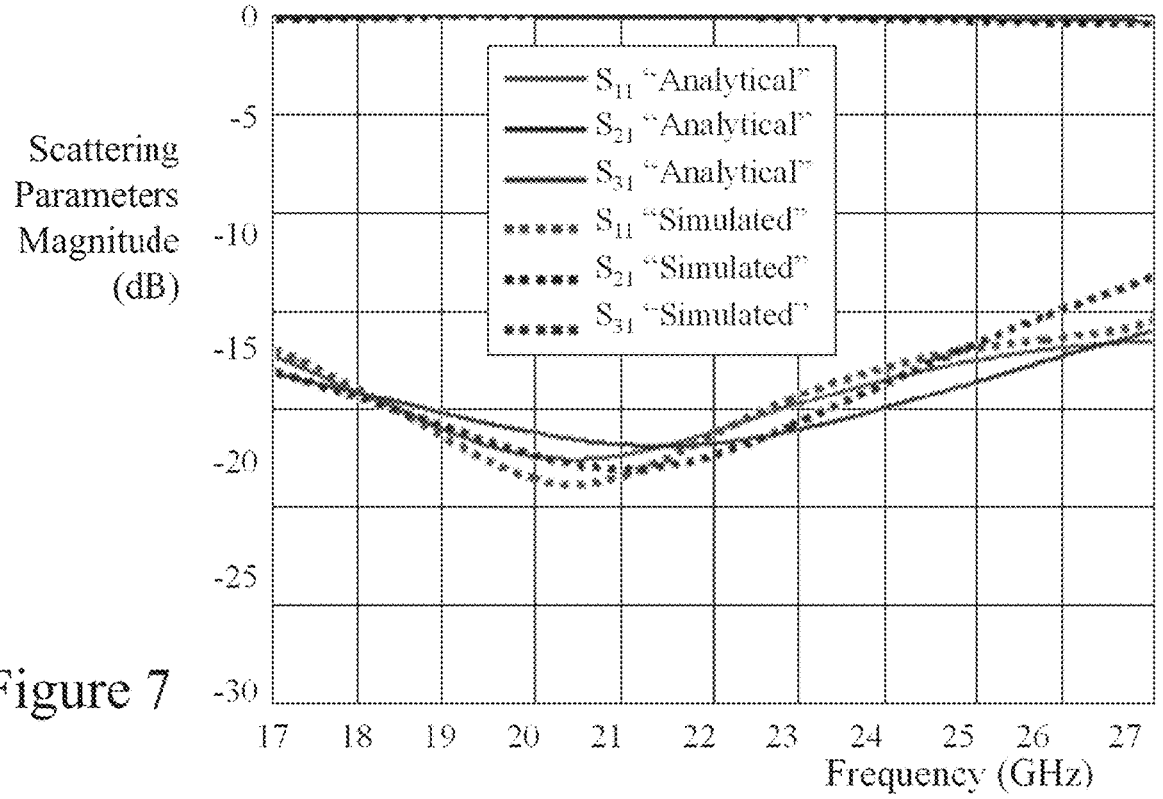
FIG. 7 depicts a comparison between theoretical and simulated responses for the exemplary K-band circulator according to an embodiment of the invention with $\alpha=0.2$.
Figure 8:
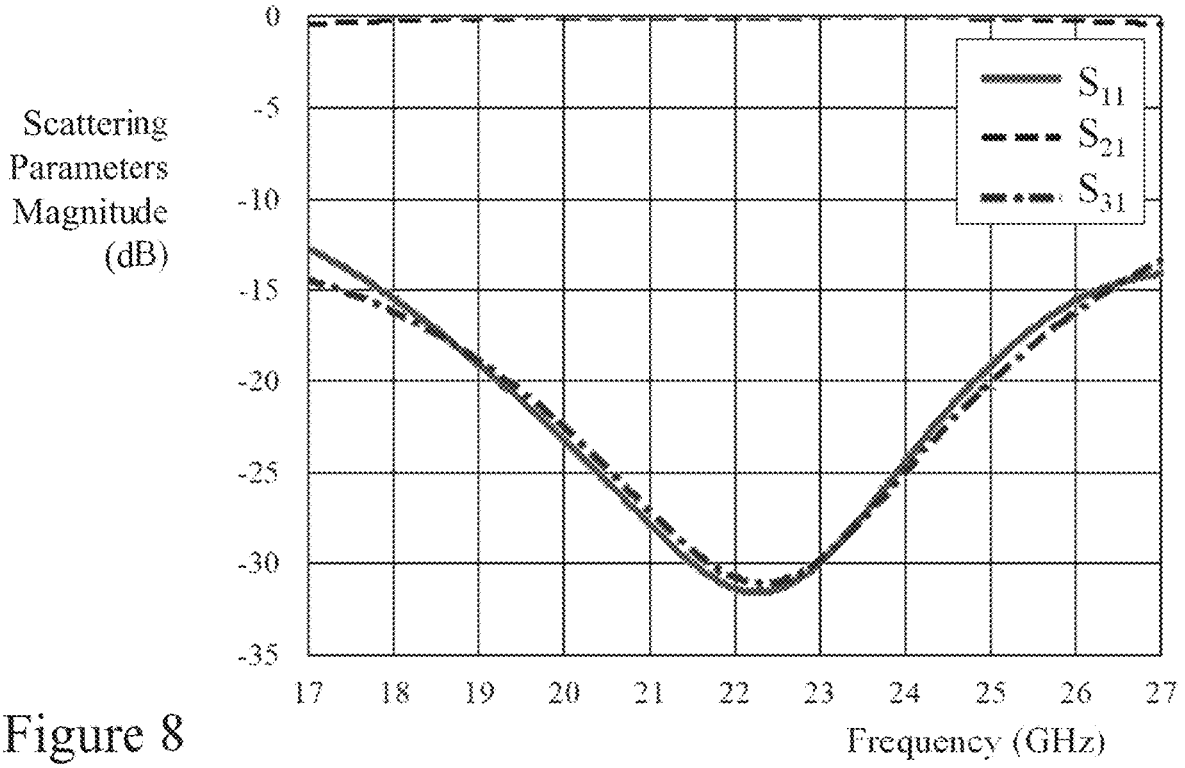
FIG. 8 depicts the scattering parameters for the exemplary K-band circulator according to an embodiment of the invention with perforated matching transformer and $\alpha=0.2$.

In this case, the value of the saturation magnetization of the material is changed to be $4\pi M_s$=4635.4 G, while the internal magnetic field is $H_0$=927.1$O_e$. The effective permeability and the effective wave number are changed and this will affect the radius to be a=0.0475 inches (1.207 mm). The width of the stripline is W=0.0484 inches (1.229 mm). The ferrite disc height is $H_f$=0.019 inches (0.483 mm). The selected dielectric constant is still $\varepsilon_d$=7.5, due to the same reasons discussed before. The results of this example are shown in FIG. 7, where there is an excellent agreement between the analytical model and the simulated model with the effective relative permittivity for the matching section. FIG. 8 illustrates the response final circulator response fabricated with a standard Rogers TMM10 with perforation.

6.2 Example 2: X-Band Circulator with Perforated Matching Network

In the second example, the frequency band extends from 8.2 GHz to 12.4 GHz. The used ferrite material is assumed to have the same relative permittivity of $\varepsilon_f$=12.5.

Figure 9:
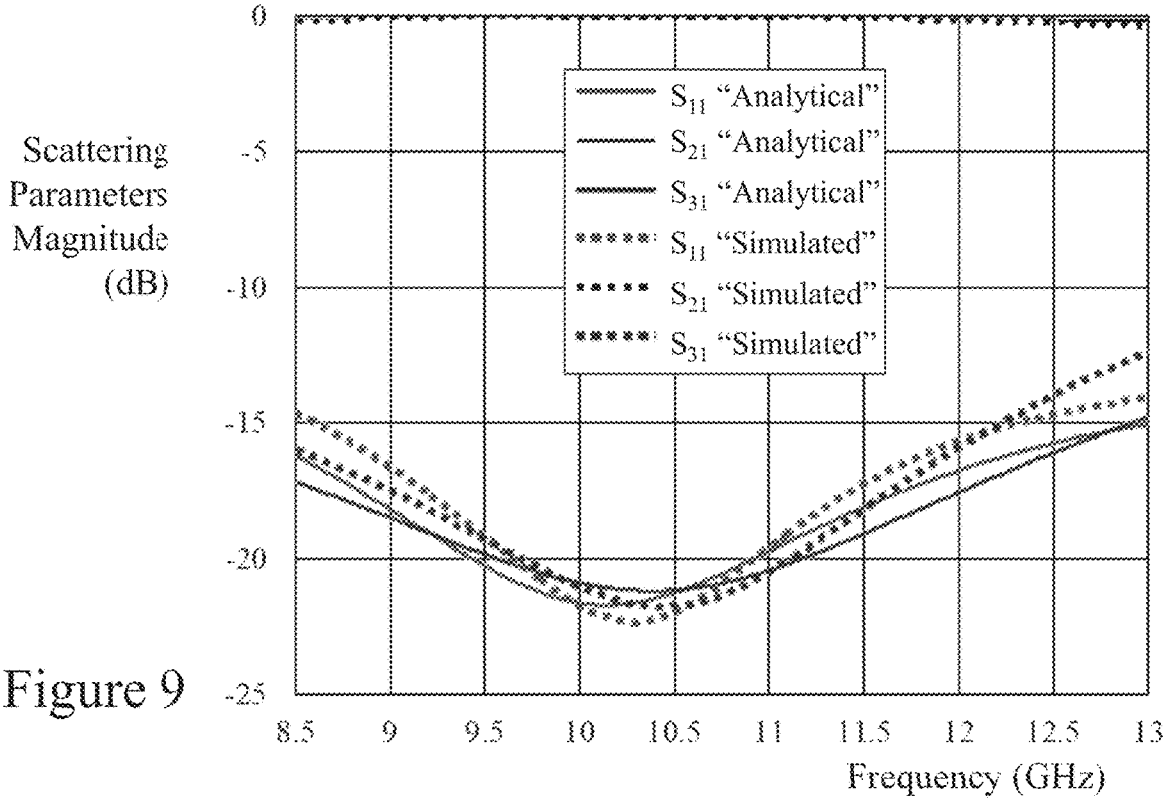
FIG. 9 depicts a comparison between theoretical and simulated responses for the exemplary X-band circulator according to an embodiment of the invention with $\alpha=0$.
Figure 10:
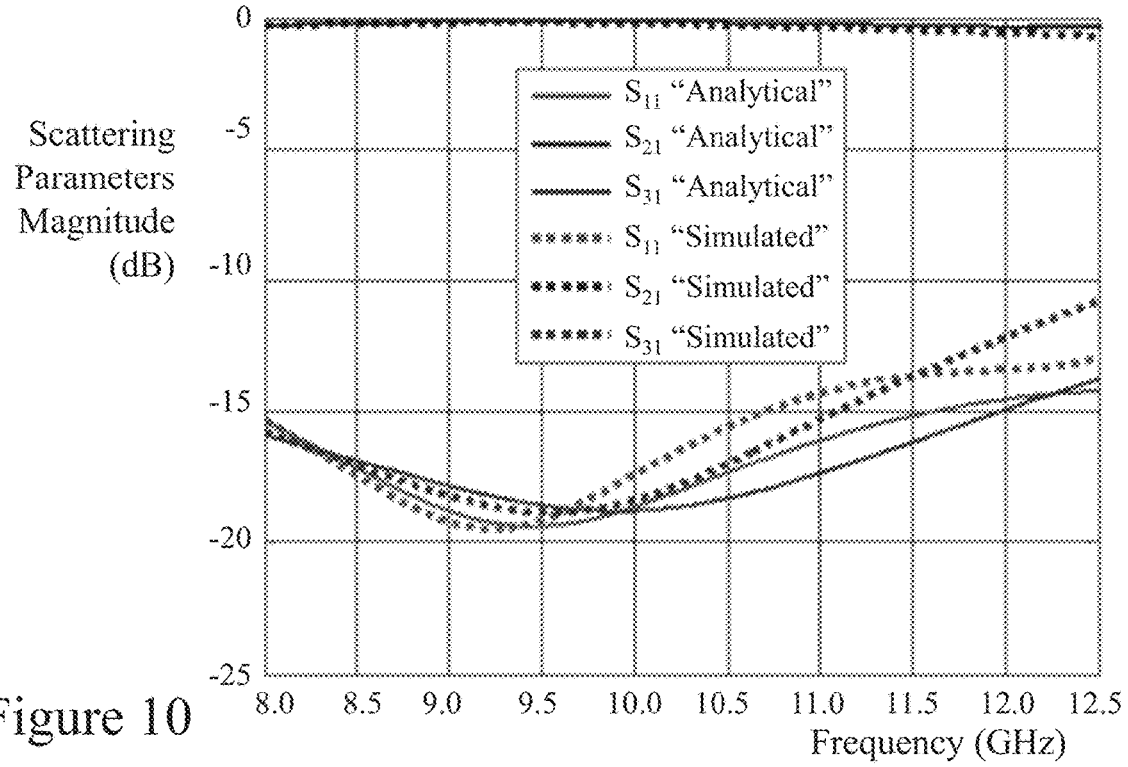
FIG. 10 depicts a comparison between theoretical and simulated responses for the exemplary X-band circulator according to an embodiment of the invention with $\alpha=0.2$.
Figure 11A:
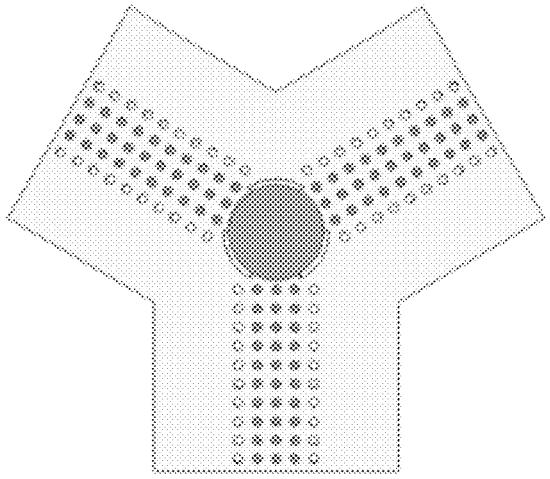
FIGS. 11A and 11B depict the exemplary K-band circulator according to an embodiment of the invention with perforations in plan and 3D views respectively.
Figure 11B:
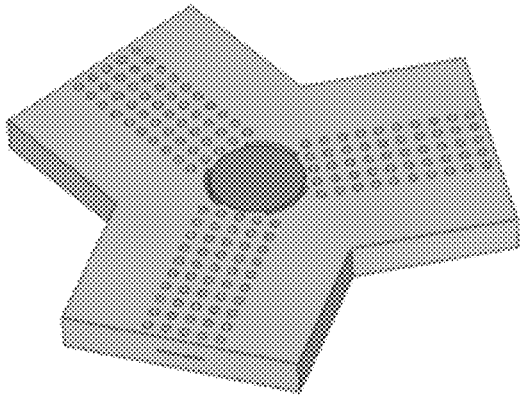
Figure 12:
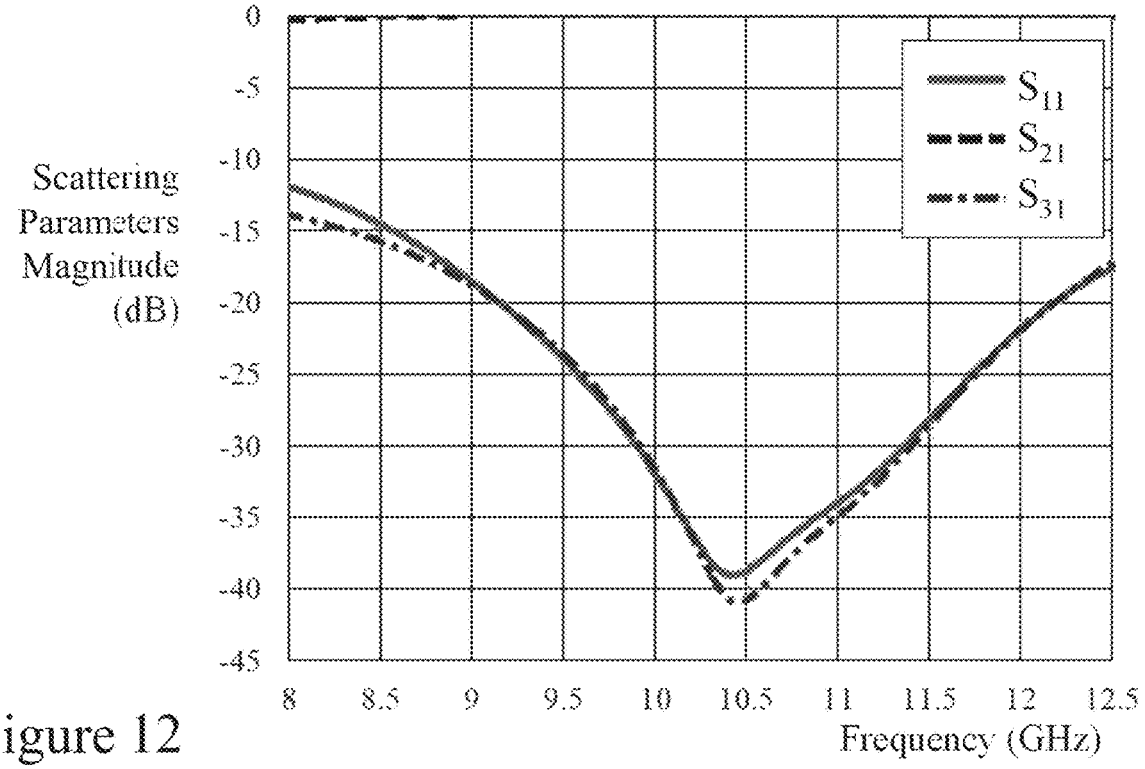
FIG. 12 depicts scattering parameters for an exemplary X-band circulator according to an embodiment of the invention with perforated matching transformer and $\alpha=0$.
Figure 13:
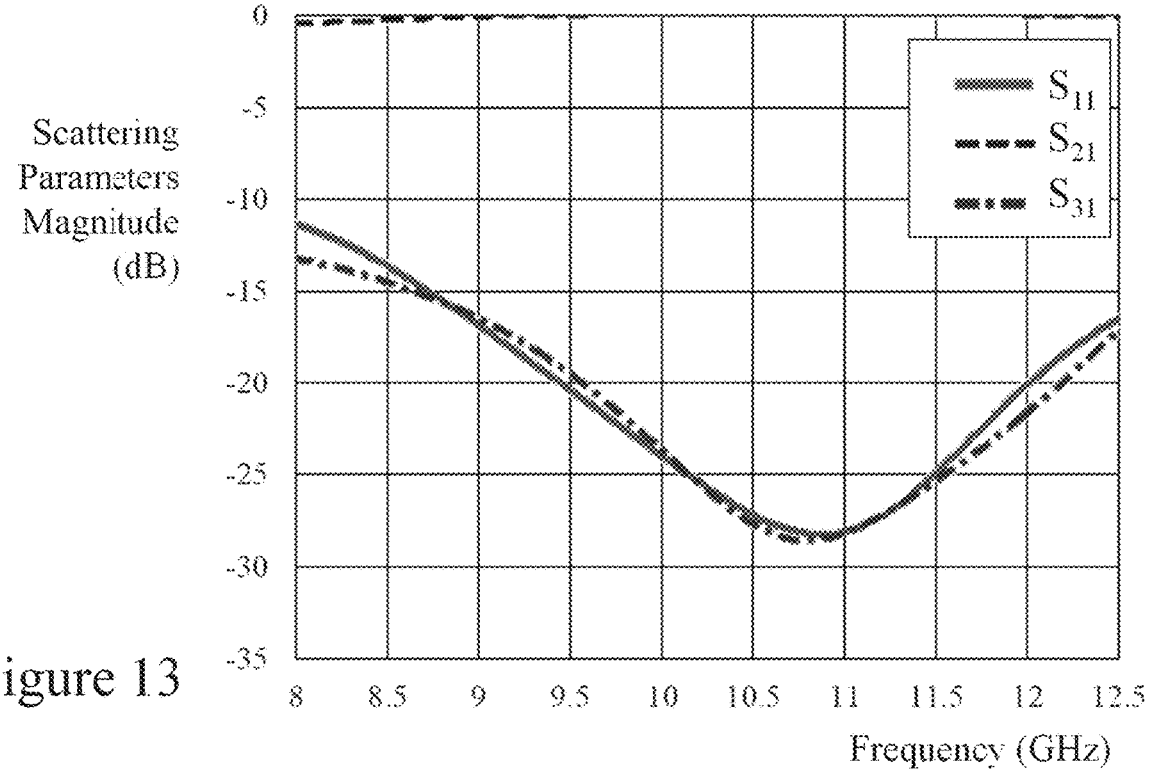
FIG. 13 depicts the scattering parameters for the exemplary X-band circulator according to an embodiment of the invention with perforated matching transformer and $\alpha=0.2$.

Both designs for this example follow the previously described procedure. This procedure results can be summarized in Table 3. The comparisons between the analytical model response and the simulated response are shown in FIGS. 9 and 10 for both designs. In the previous two figures, the relative permittivity of the filling material is selected with a nonstandard value, $\in_r$=7.5. The final step is to realize the nonstandard value of the dielectric constant through performing perforation inside a standard Rogers TMM 10 substrate. The same perforation parameters of Example 1 for the K-band circulator are deployed. The number of holes increases as the overall size of the circulator in this example is almost doubled. FIG. 11 shows the top view and the 3D view of the simulated model of the X-band circulator with perforation. The final simulated results of the X-band circulator response with perforation are shown in FIGS. 12 and 13.

TABLE 3

X-Band Circulator Designs based on Inventive Design Procedure

| Parameter | Design 1 $\alpha = 0$ | Design 2 $\alpha = 0.2$ |
|---|---|---|
| Design Frequency $f_d$ | 10.815 GHz | 10.815 GHz |
| Ferrite Saturation Magnetization $4\pi M_s$ | 2317.5 G | 2145.8 |
| Magnetic Biasing Ratio $\alpha$ | 0 | 0.2 |
| Effective Permeability $\mu_{eff}$ | 0.640$\mu_o H/m$ | 0.568$\mu_o H/m$ |
| Effective Wave Number $k_{eff}$ | 640.66 | 603.55 rad/m |
| Gytropy $g_K$ | 0.6 | 0.6 |
| Ergodic Equation Solution for $x$ | 1.5727 | 1.5727 |
| Ergodic Equation Solution for $\psi$ | 0.5344 | 0.5344 |
| Ferrite Disc Radius $a$ | 0.0966" (2.454 mm) | 0.1026" (2.606 mm) |
| Stripline Width $W$ | 0.0980" (2.489 mm) | 0.1045" (2.654 mm) |
| Ferrite Disc Height $h_f$ | 0.0387" (0.983 mm) | 0.0410" (1.041 mm) |
| Stripline Filling Relative Permittivity $\varepsilon_d$ | 7.5 | 7.5 |

6.3. Perforation Design

An important step within the innovative design methodology is the replacement of the ideally simulated matching section with a conventional perforated substrate that has a very close relative permittivity value to the assumed one. The implementation of a certain value of the relative permittivity using a standard substrate of a higher relative permittivity is discussed in many applications like the dielectric resonator antennas and reflectarrays, see for example Helszajn et al. in ""Fringing Effects in Re-Entrant and Inverted Re-Entrant Turnstile Waveguide Junctions using Cylindrical Resonators" (IET Microwaves, Antennas & Propagation, Vol. 5, No. 9, pp. 1109-1115). Many equations relate between the perforation dimensions and the effective relative permittivity. Equation (90) is described in a lot of work related to reflectarrays, e.g. Moeine-Fard et al. in "Inhomogeneous Perforated Reflect-Array Antennas" (Wireless Engineering and Technology, 2011) to provide this relation where $d_h$ and $g_h$ are the hole diameter and the gap between two adjacent holes respectively. The minimum possible hole diameter is a limiting factor determined by the available machining facility, while the maximum hole diameter considered has to ensure that the medium will act in a homogenous way. The maximum hole diameter value should be less than one tenth of the wavelength at the max frequency within the operating bandwidth. The required initial value of the hole diameter is obtained from the previous equation. As Equation (90) is related to the reflect array problems, where the wave is normally incident on the top face of the perforated substrate, the selected values of the hole diameters should be verified and tuned to achieve the required dielectric constant. A numerical extraction for the relative permittivity is performed by simulating a parallel plate waveguide filled with the perforated substrate, then the relative permittivity is extracted from the phase of $S_{21}$ as the mode propagating in this case is pure TEM mode. Through this simple simulation, the perforation parameters can be tuned to achieve the design value of the effective dielectric constant.

$$\varepsilon_{eff} = \varepsilon_r\left(1 - \frac{\pi}{2\sqrt{3}}\left(\frac{d_h}{d_h + g_h}\right)^2\right) + \frac{\pi}{2\sqrt{3}}\left(\frac{d_h}{d_h + g_h}\right)^2 \quad (90)$$

6.4 The Field Distribution

Figure 14A:
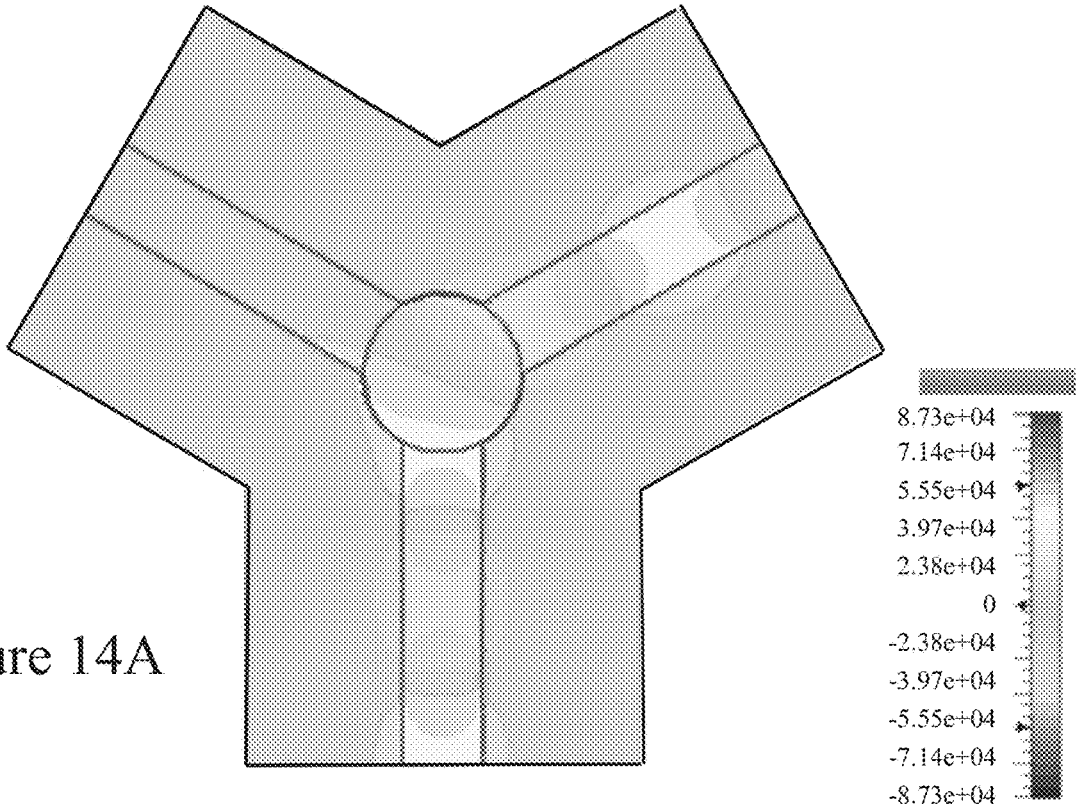
FIG. 14A depicts the axial electric field within the exemplary X-band circulator according to an embodiment of the invention at f=23.3 GHz.
Figure 14B:
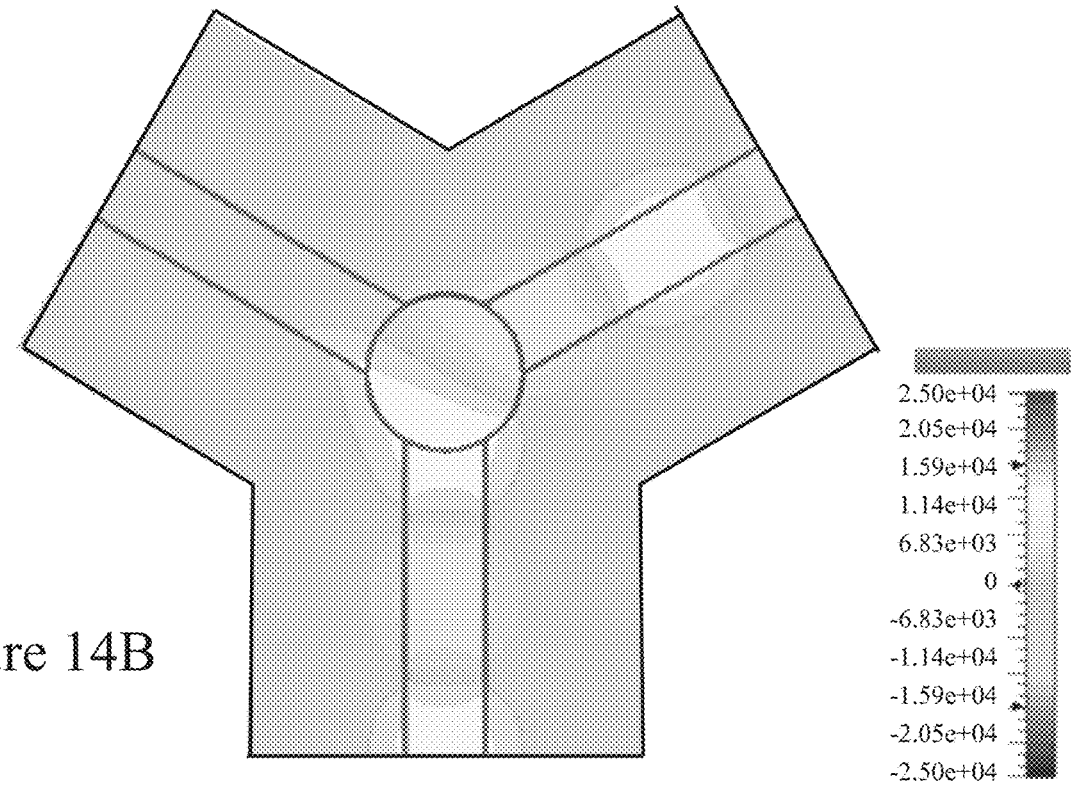
FIG. 14B depicts the axial electric field within the exemplary K-band circulator according to an embodiment of the invention at f=10.82 GHz.

The objective for the selected design parameters is to satisfy the circulator conditions. These conditions can be depicted from FIGS. 14A and 14B, where the axial field distribution is plotted in one case of each example. As it can be observed clearly that the field is concentrated at port 1 and port 2 while no field is penetrating port 3. This last port is considered as the isolation port. It is evident in this figure also that there is some small field distribution outside the ferrite disc. This leads to some discrepancy between the analytical model and the simulated results.

6.5 Examples 3 & 4: 5G 15 GHz and 30 GHz Circulators with Ridge Gap Waveguide Matching Networks In this section a detailed design procedure is presented for the circulator designs which follows essentially the same procedure as that outlined in Section 6.1 for the K-band circulator (and employed in Section 6.2 for the X-band circulator) is presented based upon a Ridge Gap Waveguide (RGW) circulator with ideal Boundary conditions such as depicted in FIGS. 3E to 3H respectively. In this instance, the RGW is implemented with ideal PMC boundaries.

Step 1: Assuming the Gytropy value in the range between −1 to 0 for below resonance mode of operation. It is recommended to be limited in between −0.2 and −0.8 to avoid resonance losses and below saturation losses. These facts are addressed within the prior art. Whilst it is possible also to select positive values of the Gytropy for the high resonance mode of operation the prior art denotes that such devices usually have smaller operating bandwidths. The saturation magnetization of the ferrite disc can be calculated through Equation (89).

Step 2: The input reactance is equated to zero to find the ferrite radius and the coupling angle.

Step 3: The ferrite height is assumed, where $h_f \leq a$ (assuming $h_f=0.4a$). This condition ensures the neglected axial variations as assumed in the analysis. This is a design parameter, which means that this height can take many other values as long as the axial variation is neglected.

Step 4: The input resistance is calculated at the design frequency.

Step 5: Design the matching network to connect the junction to the feeding line. It should be taken into consideration that the permittivity of the RGW should be smaller than the ferrite permittivity. As such, a PMC boundary assumption at the perimeter of the ferrite disc between the ports is a valid approximation. A roughly estimated limit is that $\varepsilon_{d,max}=0.8\varepsilon_f$, where the dielectric filling of the RGW has a relative permittivity of $\varepsilon_d$, while the ferrite relative permittivity is $\varepsilon_f$. There are no definite limits for the maximum value of the dielectric permittivity deployed for matching. However, the PMC boundary assumption is increasingly violated when both values are getting closer. After calculating the required value of the relative permittivity for the matching, a lower value should be considered. The objective is the RGW circulator design, which has more fringing fields around the ridge compared to the model with PMC surface. This results in having a larger effective electrical width than the physical width. The characteristic impedance of RGW will be smaller than the ideal model. To compensate for this phenomenon, in advance, the utilized dielectric constant is lower than the required one by 30%.

Step 6: Finally, the analytically predicted response of the scattering parameters has to be compared to the simulated response based on ideal boundary conditions.

Step 7: RGW circulator realization, wherein the objective of this step is to replace the PMC boundary around the ridge with the periodic cells. To achieve that, the following two-step procedure is performed:

Step 7A: Design the periodic cell with the same gap height with a bandgap that contains the circulator operating bandwidth.

Step 7B: Replace the ideal PMC surface with the designed cells. Hence, further optimization should be performed to obtain the required response, if needed.

As mentioned supra the design frequencies are $f_{d1}=15$ GHz and $f_{d1}=30$ GHz. The assumed Gytropy is chosen to be −0.6. This value is a design parameter, i.e. it can be selected with any value in the specified range. The saturation magnetization of the ferrite is calculated using Equation (89) to be $4\pi M_S=3214.3G$; 6428.6G, respectively. The dielectric constant of the ferrite materials should be obtained from the ferrite provider where the nominal value of this parameter is typically between 12 and 15. An example of a ferrite being TT1-3000 which has a specified $\varepsilon_f=12.9$ The ferrite materials can be custom made with a specific $4\pi M_S$ or can be ordered with standard values. If the required material is not available, the designer can use a material with slightly lower $4\pi M_S$ and obtain the same Gytropy by extra magnetization. It is assumed here that the required value is available.

The imaginary part of the input impedance is equated to zero. This results in a coupling angle $\psi=0.5344$ radians for both designs and ferrite disc radii are $a_1=0.0686"$ (1.742 mm) and $a_1=0.0343"$ (0.871 mm). Hence, the ferrite heights can be assumed to be $h_{f1}=0.4*0.0686=0.0274"$ (0.696 mm) and $h_{f1}=0.4*0.0343=0.0137"$ (0.348 mm). It is important to notice that, both, the coupling angle and the disc radius, determine the ridge width. This width $W_r$ can be calculated through Equation (29) 6, where $W_{r1}=0.0699"$ (1.775 mm) and $W_{r1}=0.0349"$ (0.886 mm). The input resistance of the ferrite disc is equal to 16.82Ω in both cases, but the characteristic impedance of the air filled RGW is 54.98Ω. The RGW characteristic impedance is calculated approximately through the stripline Equation (83).

Figure 15A:
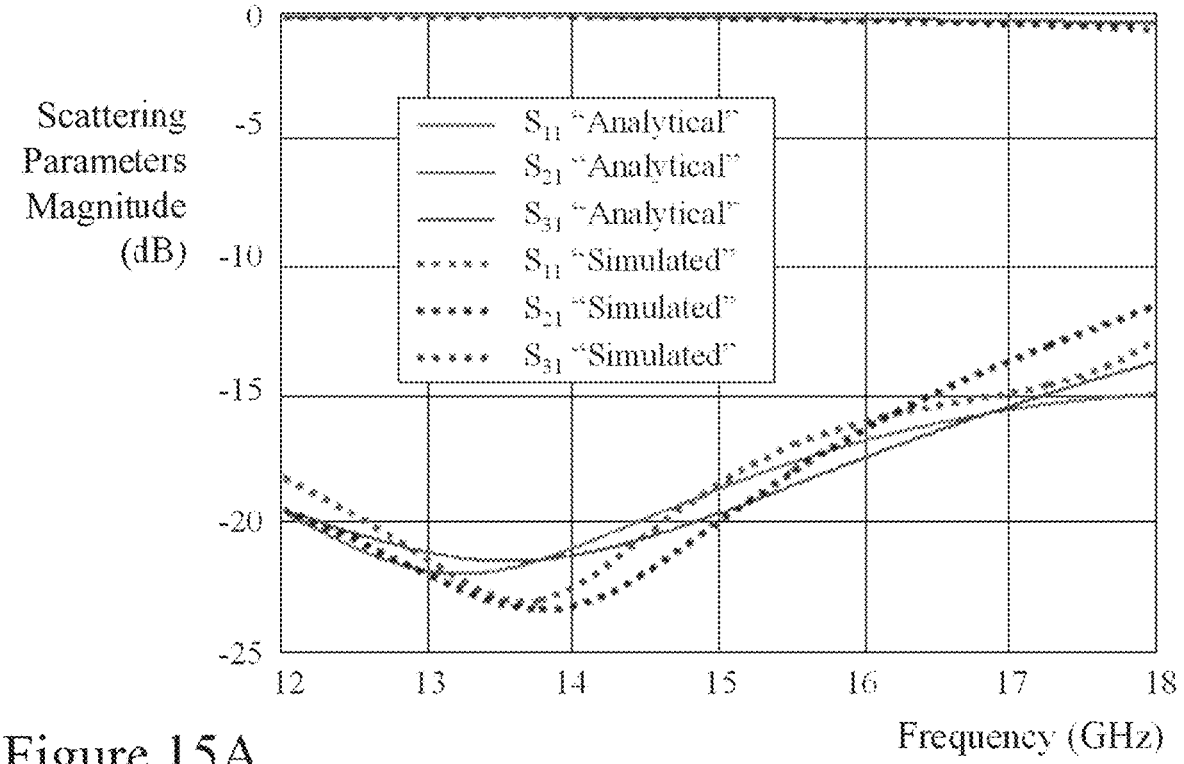
FIGS. 15A and 15B depict the comparison between the analytical and the simulated response of the RGW circulators with ideal PMC around the ridge for the 15 GHz and 30 GHz designs respectively.
Figure 15B:
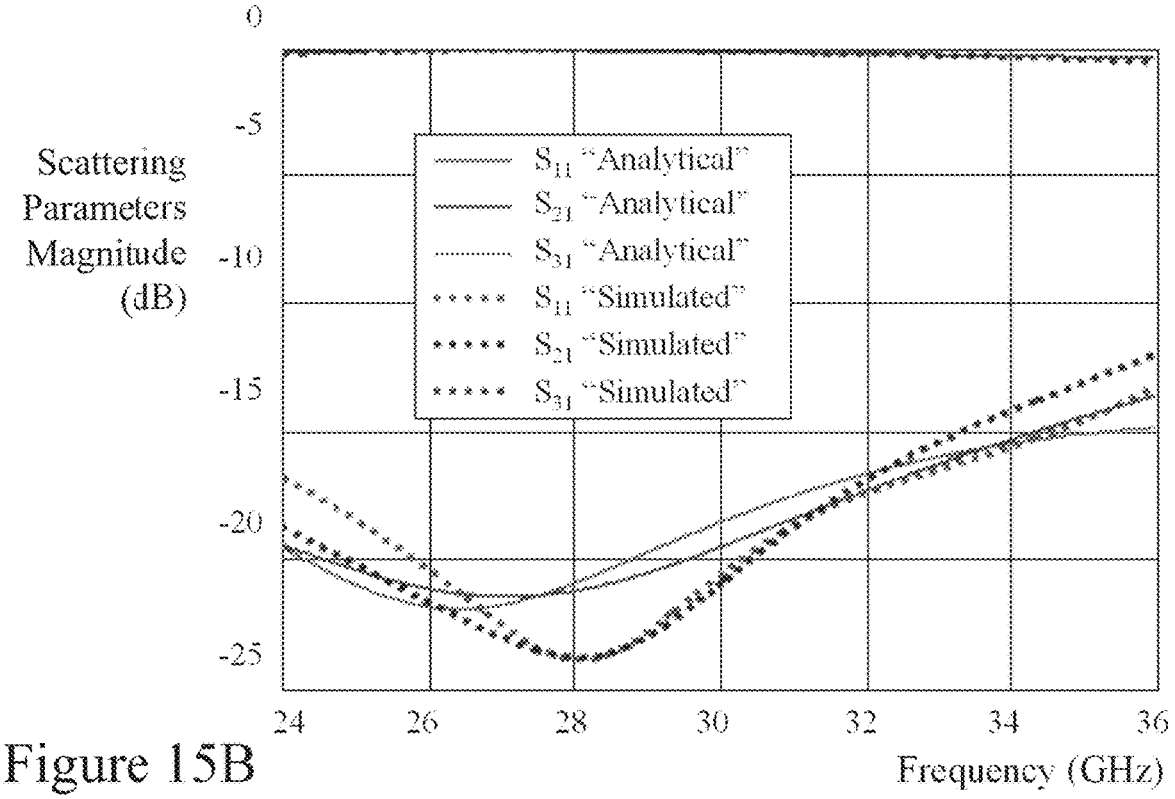

The required dielectric constant to ensure the desired matching is above 10. As mentioned before, the selected filling material of $\varepsilon_d=7.75$, which is around 30% below the required value for the matching. As noted previously the simulated model of the RGW circulator is depicted in FIGS. 3E to 3H where FIG. 3G focuses on the top PEC boundary condition, and FIG. 3H shows the PMC boundary. The PMC boundary is considered only to obtain the ideal RGW response. The comparison between the analytical and the simulated response are depicted in FIGS. 15A and 15B for the 15 GHz and 30 GHz designs. The circulator response is considered in a 40% bandwidth centered at the design frequency. It is evident from FIGS. 15A and 15B that the designs are shifted down in frequency, intentionally. This shift is due to the deployed matching section. The dielectric constant used in matching is less than the required value in order to compensate for the expected change in the characteristic impedance of the ridge. Both designs cover more than 25% bandwidth with a matching and isolation levels of −15 dB, while the proposed bandwidths for 5G mobile applications do not exceed 10%. In addition, the realization of this design by RGW will compensate for the frequency shift, which will increase the circulator bandwidth. This is explained in the following description.

The periodic cells deployed in these RGW designs are the traditional "bed of nails" unit cell (BNUC). These types of cells can achieve a bandwidth better than 2:1 and in some applications, when the operating bandwidth exceeds 2.5:1, other types of unit cells have to be used. The design of the BNUC is well covered within the prior art and is depicted in FIGS. 16A and 16B, whilst the Eigenmode solutions are depicted in FIGS. 16C and 16D, The cell dimensions are the cell width $W_C$, the pin width $W_P$, the gap height $h_g$ and the pin height $h_p$. The values of these parameters are listed in Table 4 for both designs, where the gap height of the cell is precisely equal to the ferrite disc height. It is evident from FIGS. 16C and 16D that the stop band of the designed cells covers wider bandwidths in both cases that required.

Figure 17:
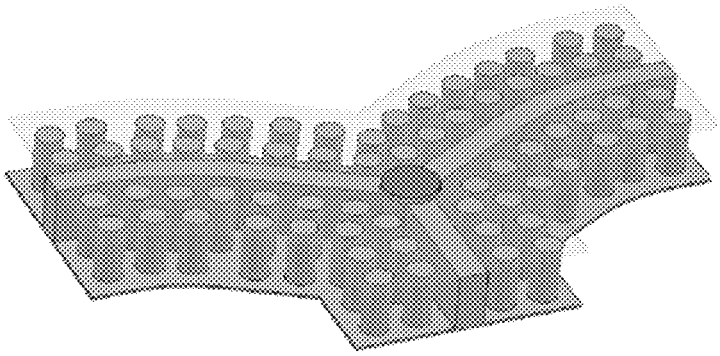
FIG. 17 depicts a 3D view of the realized RGW circulator exploiting the "bed of nails"
Figure 18A:
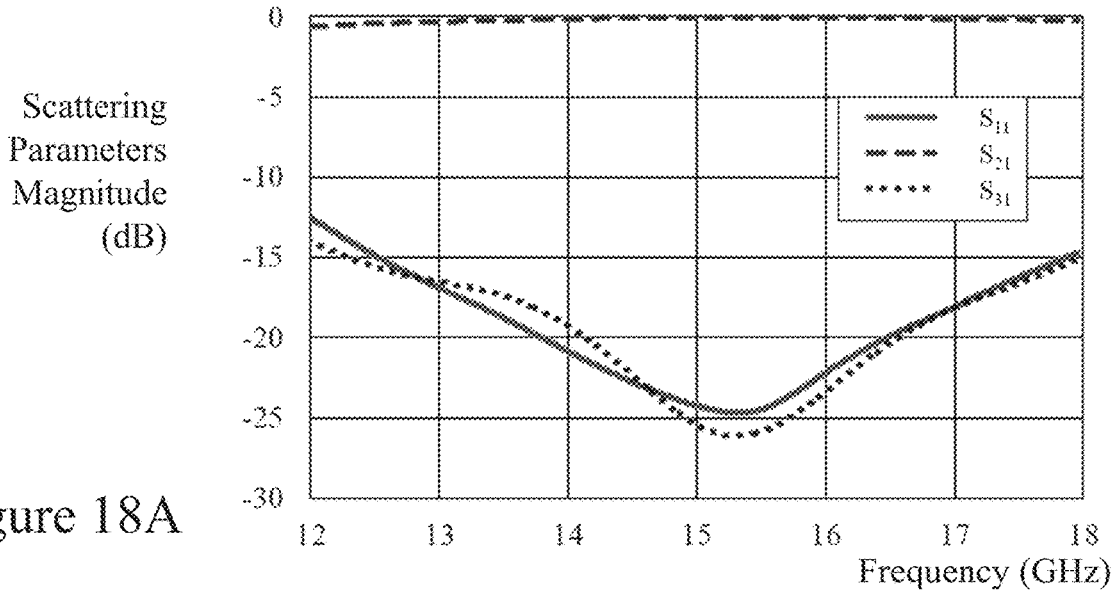
FIGS. 18A and 18B depict scattering parameters for the 15 GHz and 30 GHz RGW circulators respectively.
Figure 18B:
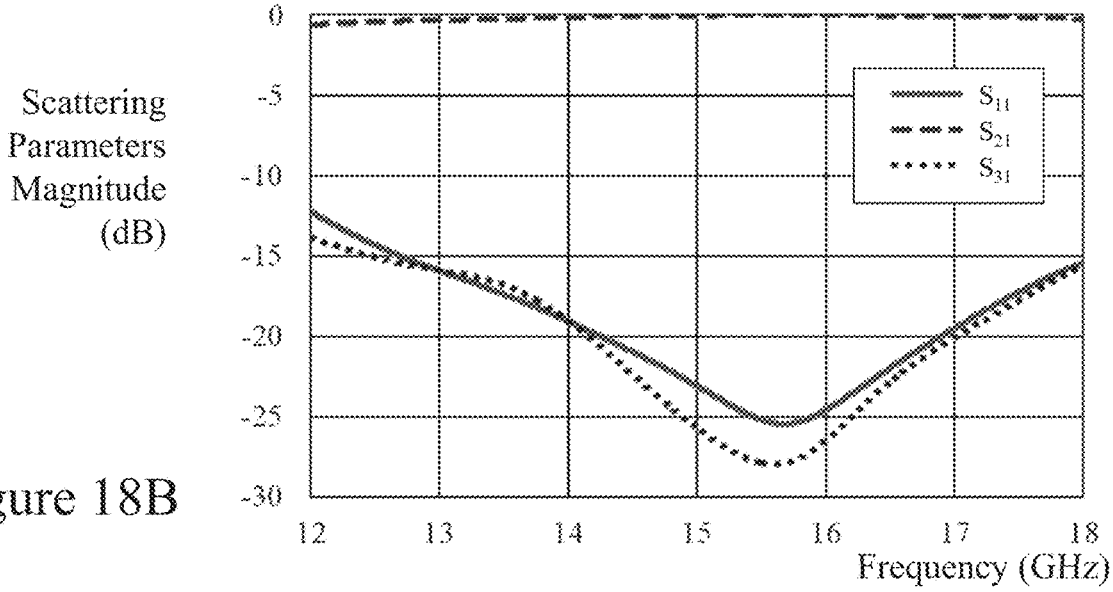

The cells are placed surrounding the ridge to keep the PMC boundary conditions assumed in the ideal deign. The circulator configuration is shown in FIG. 17, where the upper ground is removed to show the structure details. The responses of the final designs are presented in FIGS. 18A and 18B. It is evident from these figures that the curves are shifted up again. The practical ridge implementations have more field fringing around the ridge compared to the ideal PMC boundaries, which increases the effective width of the ridge. The wider ridge reduces the characteristic impedance of the feeding line, which compensates the characteristic impedance of the matching network. The final design covers, almost, a 40% bandwidth with a matching level of −15 dB. It would be evident that other different matching techniques or multiple stage matching networks can be employed to provide wider operating bandwidths without departing from the design and device construction methodologies according to embodiments of the invention.

TABLE 4

Bed of Nail Unit Cell Dimensions

| Dimension | Design 1 Value (inch/mm) | Design 2 Value (inch/mm) |
|---|---|---|
| Cell width, $W_C$ | 0.1813"/4.605 mm | 0.0515"/2.499 mm |
| Pin width, $W_P$ | 0.0976"/2.479 mm | 0.0343"/0.871 mm |
| Gap height, $h_g$ | 0.0279"/0.709 mm | 0.0137"/0.348 mm |
| Pin height $h_p$ | 0.1813"/4.605 mm | 0.0984"/2.499 mm |

7. Circulator Power Handling

The power handling of any microwave device is measured by two major parameters, the maximum power, and the average power. Regarding the maximum power that can be handled by a circulator according to the inventive design methodology, then it is limited only by the stripline feeding structure at the height of the structure is kept the same. The matching element deployed in the matching section design is the dielectric filling, and the gap height is not utilized as a tuning element. Moreover, the average power that can be handled by this structure is increased as a direct effect of the dielectric filling of the stripline. The dielectric filling helps in transferring the heat generated inside the ferrite disc away by conduction. Most of the heat generated inside the ferrite disc is located at the high field spots. These areas are in a direct contact with the dielectric filling of the feeding lines.

8. Options

Within the embodiments of the invention described and depicted supra the dielectric material disposed on the electrically non-conductive and ferromagnetic material, e.g. ferrite, is assumed to be air. However, it would be evident that in other embodiments of the invention the dielectric material may be another material with low dielectric constant such as an inert gas, e.g. nitrogen, argon, carbon dioxide, etc., or an inert filler material such as a xerogel/aerogel or spin-on polymer such as Teflon/PTFE provided that the required design requirements can be met.

Similarly, the dielectric within the outer portion of the microwave circulator providing the microwave matching circuit may be composed of a standard solid dielectric, a ridge gap waveguide (or multi-ridge waveguide) comprising metallic insertions on the top and/or bottom walls, an RGW waveguide, which is implemented with a "bed of nails" or alternatively it may employ a microwave waveguide employing a plurality of posts with a first predetermined material and diameter embedded with a filler of a second predetermined material.

APPENDIX A

1: The Stripline Electric and Magnetic Field Distribution

FIG. 14 illustrates the stripline configuration at port 1, which is addressed in the following analysis. Starting from Laplace equation, Equation (91) in the transverse direction where the boundary conditions are defined by Equation (92).

$$\nabla_t \Phi(y,z)=0 \tag{91}$$

$$\Phi(y,z)=0 \quad y=\pm W_t/2 \tag{92}$$

$$\Phi(y,z)=0 \quad z=\pm h_f \tag{93}$$

Although the real model does not have PEC boundaries in the y− direction, but the total width $W_t$ is very large compared to the stripline width W. As $W_t$>>W, the effect of the hypothetical PEC side boundaries will be neglected. Solving Laplace equation and applying the boundary conditions, the expression in Equation (94) is obtained. Then the axial electric field can be obtained through $$E_z = \frac{\partial}{\partial z}$$

(Φ) to be that given in Equation (95).

$$\Phi(y,z) = \begin{cases} \sum_{m\ odd} B_m \cos\left(\frac{m\pi}{W_t}y\right)\sinh\left(\frac{m\pi}{W_t}(z-h_f)\right) & 0>z>-h_f \\ \sum_{m\ odd} B_m \cos\left(\frac{m\pi}{W_t}y\right)\sinh\left(\frac{m\pi}{W_t}(h_f-z)\right) & h_f>z>0 \end{cases} \tag{94}$$

$$E_z = \begin{cases} \sum_{m\ odd} B_m \cos\left(\frac{m\pi}{W_t}y\right)\cosh\left(\frac{m\pi}{W_t}(z-h_f)\right) & 0>z>-h_f \\ \sum_{m\ odd} B_m \cos\left(\frac{m\pi}{W_t}y\right)\cosh\left(\frac{m\pi}{W_t}(h_f-z)\right) & h_f>z>0 \end{cases} \tag{95}$$

$$B_m = \frac{2W_t \sin(m\pi W/2W_t)}{(m\pi)^2 \varepsilon \cosh(m\pi h_f/W_t)} \tag{96}$$

Assuming uniform charge distribution along y-direction at the center strip ((W/2)>y>(−W/2),z=0) the constant $B_m$ can be obtained as given by Equation (96). As the propagating modes along the stripline are TEM, the magnetic field H_y can be obtained by multiplying the axial electric field by Y_0 (the characteristic admittance). Hence, the tangential field on the disc surface H_Ø can be obtained from the expression of H_y by direct resolution. The axial electric field and the tangential magnetic field can be obtained as given by Equations (97) and (98) respectively.

$$E_z = \begin{cases} -\sum_{m\ odd} \frac{2}{m\pi} \frac{\sin\left(\left(\frac{m\pi}{2\sqrt{3}}\right)\psi\right)}{\varepsilon\cosh\left(\frac{m\pi h}{W_p}\right)} \cos\left(\frac{m\pi}{2\sqrt{3}}\phi\right)\cosh\left(\frac{m\pi}{W_p}(z-h)\right) & (A) \\ \sum_{m\ odd} \frac{2}{m\pi} \frac{\sin\left(\left(\frac{m\pi}{2\sqrt{3}}\right)\psi\right)}{\varepsilon\cosh\left(\frac{m\pi h}{W_p}\right)} \cos\left(\frac{m\pi}{2\sqrt{3}}\phi\right)\cosh\left(\frac{m\pi}{W_p}(h-z)\right) & (B) \\ \sum_{m\ odd} \frac{2}{m\pi} \frac{\sin\left(\left(m\pi/2\sqrt{3}\right)\psi\right)}{\varepsilon\cosh\left(m\pi h/W_p\right)} \cos\left(\frac{m\pi}{2\sqrt{3}}\left(\phi-\frac{2\pi}{3}\right)\right)\cosh\left(\frac{m\pi}{W_p}(z-h)\right) & (C) \\ -\sum_{m\ odd} \frac{2}{m\pi} \frac{\sin\left(\left(\frac{m\pi}{2\sqrt{3}}\right)\psi\right)}{\varepsilon\cosh\left(\frac{m\pi h}{W_p}\right)} \cos\left(\frac{m\pi}{2\sqrt{3}}\left(\phi-\frac{2\pi}{3}\right)\right)\cosh\left(\frac{m\pi}{W_p}(z-h)\right) & (D) \end{cases} \tag{97}$$

$$E_z = \begin{cases} -\sum_{m\ odd} \frac{2Y_0}{m\pi} \frac{\sin\left(\left(\frac{m\pi}{2\sqrt{3}}\right)\psi\right)}{\varepsilon\cosh\left(\frac{m\pi h}{W_p}\right)} \cos\left(\frac{m\pi}{2\sqrt{3}}\phi\right)\cosh\left(\frac{m\pi}{W_p}(z-h)\right) & (A) \\ \sum_{m\ odd} \frac{2Y_0}{m\pi} \frac{\sin\left(\left(\frac{m\pi}{2\sqrt{3}}\right)\psi\right)}{\varepsilon\cosh\left(\frac{m\pi h}{W_p}\right)} \cos\left(\frac{m\pi}{2\sqrt{3}}\phi\right)\cosh\left(\frac{m\pi}{W_p}(h-z)\right) & (B) \\ -\sum_{m\ odd} \frac{2Y_0}{m\pi} \frac{\sin\left(\left(\frac{m\pi}{2\sqrt{3}}\right)\psi\right)}{\varepsilon\cosh\left(m\pi h/W_p\right)} \cos\left(\frac{m\pi}{2\sqrt{3}}\left(\phi-\frac{2\pi}{3}\right)\right)\cosh\left(\frac{m\pi}{W_p}(z-h)\right) & (C) \\ \sum_{m\ odd} \frac{2Y_0}{m\pi} \frac{\sin\left(\left(\frac{m\pi}{2\sqrt{3}}\right)\psi\right)\cos\left(\phi-\frac{2\pi}{3}\right)}{\varepsilon\cosh\left(\frac{m\pi h}{W_p}\right)} \cos\left(\frac{m\pi}{2\sqrt{3}}\left(\phi-\frac{2\pi}{3}\right)\right)\cosh\left(\frac{m\pi}{W_p}(z-h)\right) & (D) \end{cases} \tag{98}$$

$(A)\ 0 > z > -h,\ \psi > \phi > -\psi \quad (C)\ 0 > z > -h,\ \frac{2\pi}{3} + \psi > \phi > \frac{2\pi}{3} - \psi$ $(B)\ h > z > 0,\ -\psi > \phi > -\psi \quad (D)\ h > z > 0,\ \frac{2\pi}{3} + \psi > \phi > \frac{2\pi}{3} - \psi$ 2. The Stripline Junction Circulator Integral As each port boundary, can be estimated to exist in the range $$\frac{2\pi}{2} + \phi_P > \phi > \frac{2\pi}{2} - \phi_P.$$

The value of $$\phi_P = 0,\ \frac{2\pi}{3},\ \frac{4\pi}{3}$$

for ports 1, 2, and 3, respectively. Based on this fact the ratio of $W/W_1$ can be obtained to be $1/\sqrt{3}$.

$$I_1(\psi, m, n) = \int_{-\psi}^{\psi} \cos\left(\frac{m\pi}{2\sqrt{3}}\phi\right)\cos(\phi)e^{-jn\phi}d\phi \tag{99}$$

The foregoing disclosure of the exemplary embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A microwave circulator comprising:

a pair of electrically non-conductive and ferromagnetic elements with specific magnetic saturation value ($M_s$) each having a predetermined thickness and a predetermined diameter;

an electrical conductor plane comprising a plurality of microwave tracks and a central circular pad to which each microwave track is coupled at a predetermined location, each microwave track comprising a first portion adjacent the central pad and a second portion extending from the first portion to a distal point;

a lower electrical ground plane;

an upper electrical ground plane;

a first dielectric disposed between the electrical conductor plane and the lower electrical ground plane and having a thickness determined in dependence upon the predetermined thickness of the electrically non-conductive and ferromagnetic elements and an opening determined in dependence upon the predetermined diameter of the electrically non-conductive and ferromagnetic elements;

a second dielectric disposed between the electrical conductor plane and the upper electrical ground plane and having a thickness determined in dependence upon the predetermined thickness of the electrically non-conductive and ferromagnetic elements and an opening determined in dependence upon the predetermined diameter of the electrically non-conductive and ferromagnetic elements; wherein the openings within the first dielectric and second dielectric have a diameter establishing a predetermined air gap between the external periphery of an electrically non-conductive and ferromagnetic element and their respective dielectric when the electrically non-conductive and ferromagnetic element is centrally disposed with the opening;

the first portion of each microwave track is air filled microwave track; and the second portion of each microwave track is a dielectric filled microwave track.

2. The microwave circulator according to claim 1, wherein the second portion of each microwave track is a matching transformer between the impedance of the central portion and an external microwave circuit to be coupled to the microwave circulator.

3. The microwave circulator according to claim 1, wherein the pair of electrically non-conductive and ferromagnetic elements are formed from a ferrite.

4. The microwave circulator according to claim 1, wherein the microwave tracks are striplines or ridge gap waveguides.

5. The microwave circulator according to claim 1, wherein the second dielectric is comprised of a plurality of posts of a first predetermined material, and predetermined diameter disposed in a predetermined pattern within a filler of a second predetermined material.

6. The microwave circulator according to claim 1, wherein the pair of electrically non-conductive and ferromagnetic elements are formed from a ferrite;

the microwave tracks are ridge gap waveguides; and the second dielectric is comprised of a plurality of posts of a first predetermined material, and predetermined diameter disposed in a predetermined pattern within a filler of a second predetermined material.

7. The microwave circulator according to claim 1, wherein the pair of electrically non-conductive and ferromagnetic elements are formed from a ferrite;

the microwave tracks are striplines; and the second dielectric is comprised of a plurality of posts of a first predetermined material, and predetermined diameter disposed in a predetermined pattern within a filler of a second predetermined material.

8. A microwave circulator comprising:

a set of three parallel electrical planes wherein the middle electrical plane comprises a plurality of microwave tracks and a central region coupled to the plurality of microwave tracks and each outer electrical plane is a ground plane; wherein a central portion enclosed by the set of three parallel electrical layers comprises an inner region with electrically non-conductive and ferromagnetic elements of predetermined lateral dimensions disposed between each outer electrical plane and the middle electrical plane and an outer region filled with a first dielectric material of low dielectric constant such that those portions of each microwave track in this outer region form microwave feeds coupled to the central region of the middle electrical plane at predetermined locations;

an outer portion enclosed by the set of three parallel electrical layers is filled with a second dielectric material such that those portions of each microwave track in this outer portion form microwave matching networks between the portion of each microwave track in the outer region of the central portion and an external microwave circuit to be coupled to the distal ends of each microwave track from the central portion;

the plurality of microwave tracks are striplines; and the second dielectric material is comprised of a plurality of posts of a first predetermined material, and predetermined diameter disposed in a predetermined pattern within a filler of a second predetermined material.

9. The microwave circulator according to claim 8, wherein the outer region of the central portion is determined by providing a predetermined gap around each electrically non-conductive and ferromagnetic element between it and the dielectric material in the outer portion.

10. A microwave circulator comprising:

a set of three parallel electrical planes wherein the middle electrical plane comprises a plurality of microwave tracks and a central region coupled to the plurality of microwave tracks and each outer electrical plane is a ground plane; wherein a central portion enclosed by the set of three parallel electrical layers comprises an inner region with electrically non-conductive and ferromagnetic elements of predetermined lateral dimensions disposed between each outer electrical plane and the middle electrical plane and an outer region filled with a first dielectric material of low dielectric constant such that those portions of each microwave track in this outer region form microwave feeds coupled to the central region of the middle electrical plane at predetermined locations;

an outer portion enclosed by the set of three parallel electrical layers is filled with a second dielectric material such that those portions of each microwave track in this outer portion form microwave matching networks between the portion of each microwave track in the outer region of the central portion and an external microwave circuit to be coupled to the distal ends of each microwave track from the central portion;

the plurality of microwave tracks are ridge gap waveguides; and the second dielectric material is comprised of a plurality of posts of a first predetermined material, and predetermined diameter disposed in a predetermined pattern within a filler of a second predetermined material.

11. A method of designing a microwave circulator comprising:

1) establishing simulation data by solving a predetermined set of closed form equations at a predetermined frequency relating to the electrical and magnetic fields with respect to an electrically non-conductive and ferromagnetic element comprising a first predetermined portion of the microwave circulator with low dielectric constant material based microwave waveguides coupling to the electrically non-conductive and ferromagnetic element; and 2) designing a matching transformer to cover a predetermined bandwidth of operation in dependence upon the simulation data established in step (1) using high dielectric constant substrate based microwave waveguides forming a matching network between the low dielectric constant material based microwave waveguides coupling to the electrically non-conductive and ferromagnetic element and an external microwave circuit coupled to the microwave circulator, the simulation data comprising a set of physical properties of the electrically non-conductive and ferromagnetic element, a set of physical properties of a plurality of microwave ports forming a second predetermined portion of the microwave circulator and a set of electrical properties of the microwave ports.

12. The method according to claim 11, wherein the low dielectric constant material based microwave waveguides are striplines; and the low dielectric constant material is comprised of a plurality of posts of a first predetermined material, and predetermined diameter disposed in a predetermined pattern within a filler of a second predetermined material.

13. The method according to claim 11, wherein the microwave waveguides are ridge gap waveguides; and the low dielectric constant material is comprised of a plurality of posts of a first predetermined material, and predetermined diameter disposed in a predetermined pattern within a filler of a second predetermined material.

14. A method of designing a microwave circulator comprising:

1) establishing simulation data by solving a predetermined set of closed form equations at a predetermined frequency relating to the electrical and magnetic fields with respect to an electrically non-conductive and ferromagnetic element comprising a first predetermined portion of the microwave circulator; and 2) designing a matching transformer to cover a predetermined bandwidth of operation in dependence upon the simulation data established in step (1), the simulation data comprising a set of physical properties of the electrically non-conductive and ferromagnetic element, a set of physical properties of a plurality of microwave ports forming a second predetermined portion of the microwave circulator and a set of electrical properties of the microwave ports.

15. The method according to claim 14, wherein at least one of:

the electrically non-conductive and ferromagnetic element is formed from a ferrite;

the microwave ports are striplines or ridge gap waveguides;

the plurality of microwave ports are formed from a dielectric material is comprised of a plurality of posts of a first predetermined material and predetermined diameter disposed in a predetermined pattern within a filler of a second predetermined material; and the plurality of microwave ports are formed from a dielectric material is comprised of a plurality of holes of predetermined diameter filled with a first predetermined material and disposed in a predetermined pattern within a filler of a second predetermined material.

* * * * *